US005537716A

United States Patent [19]

Komamura

[11] Patent Number: 5,537,716

[45] Date of Patent: Jul. 23, 1996

[54] HINGE STRUCTURES

[76] Inventor: Takeo Komamura, 3-207, Nakasugi, Matsudo, Chiba, Japan

[21] Appl. No.: 185,502

[22] Filed: Jan. 24, 1994

[51] Int. Cl.[6] ..... G09F 1/12; E05D 1/04

[52] U.S. Cl. ..... 16/355; 16/362; 16/337; 16/319; 40/779

[58] Field of Search ..... 16/355, 362; 40/152.1, 40/155, 156

[56] References Cited

U.S. PATENT DOCUMENTS

| | | | |
|---|---|---|---|
| 3,255,544 | 6/1966 | Bornholt | 40/156 |
| 5,189,820 | 3/1993 | Komamura | 40/156 |

FOREIGN PATENT DOCUMENTS

| | | | |
|---|---|---|---|
| 4-185881 | 7/1992 | Japan | 16/355 |
| 746040 | 3/1956 | United Kingdom | 16/355 |
| 2223874 | 4/1990 | United Kingdom | 40/156 |

*Primary Examiner*—M. Rachuba

*Assistant Examiner*—Donald M. Gurley

*Attorney, Agent, or Firm*—Koda and Androlia

[57] ABSTRACT

The present invention presents hinge structures for pivotably and detachably coupling two members, i.e., an axial member and an axial member support, in which a pivotal portion is provided at the base edge of an axial blade of the axial member; a disengaging protrusion is provided at the tip edge of the axial blade; a pivotal rotation guide is extended from near the disengaging protrusion; an engaging extension is provided at the tip edge of the pivotal rotation guide; an opening is formed in the axial member support; a pivotal portion rest is formed on one side face of the opening, while an engagement rest is formed on the other side face opposite to said one side face; a curvature is formed from the engagement rest to said one side face with the pivotal portion rest formed; a lock member is pivotably or slidably provided in the axial member, with its locking claw to be engaged with the engagement rest; and said hinge structure can be pivotably and detachably provided with various auxiliary devices.

11 Claims, 31 Drawing Sheets

HINGE STRUCTURES

BACKGROUND OF THE INVENTION

1. Field of the Invention

The present invention relates to hinge structures for pivotably and detachably coupling two members such as a housing and a door, a container and a lid, an apparatus and a controller, an apparatus and a display, a frame such as a picture frame and a fastener, or a frame and an auxiliary device. The present invention also relates to hinge structures provided with a lock.

2. Prior Art

In most of the conventional hinges, two members adjacent to each other have pin receiving cylinders alternately and concentrically located nearby, and a pin is inserted into the pin receiving cylinders of both the members, to relatively pivotably couple both the members through the inserted pin. These hinges do not allow two members to be coupled without the pin inserted, and cannot be used as hinges without the pin.

In recent years, some hinges for relatively pivotally oscillatably coupling two members without using any pin or shaft have been developed. However, these hinges have structures, in which one of the members to be coupled has a hollow cylinder at the center of pivotal rotation while the other member has circular arc protrusions to be inserted and fitted in the hollow cylinder in axial direction for relative pivotal rotation, and furthermore in which either of the members is provided with outer concentric circular arc protrusions to surround the cylinder while the other member has slits to have the outer circular arc protrusions fitted in them, so that the outer circular arc protrusions may be pivotally rotated around the center of the hollow cylinder with the slits as the guide.

Furthermore, hinged frames such as hinged picture frames for holding an exhibited object to be taken out by pivotally rotating at an engaged portion have been already developed and marketed. Most of them have a structure consisting of an obverse frame and a reverse frame, and an obverse frame member and a reverse frame member are pivotably coupled by a hinge, etc. In another structure developed, frame members are connected to form a frame using separately provided fasteners such as corner fasteners or joints, etc., and in this case, the frame members are pivotally rotated through a separately provided linear or leaf spring.

There also picture frames, etc. with a lock mechanism. Most of them have the lock mechanism protruded from the frame member or fastener, and the lock mechanism can be actuated by any careless contact. When the lock mechanism is embedded in the frame member or fastener, the lock mechanism must be actuated using a tool such as a screw-driver.

Moreover, various auxiliary devices used for the picture frames, etc. have been developed and marketed; a stand to support a picture frame, etc. kept inclined, a hanger for hanging a frame, a retainer for keeping a back sheet pressed and fixed from back side, a reinforcement, etc. These auxiliary devices require any processing to be effected in the frame member, fastener or back sheet of the picture frame, etc.

When it is wished to place plural picture frames, etc. side by side, the picture frames, etc. are fastened to a wall, etc. using respectively separate fasteners, or linear members are spread across or rod members are stood against something on the back side of the picture frames, etc., to have the picture frames, etc. fastened by respective fasteners.

Problems to be Solved by the Invention

Among the conventional hinge structures, the hinge structure using an axial pin has a pin inserted between both the members for pivotably coupling them, and the two members can be decoupled only by removing the pin or removing the screws, etc. fixing one of the members. The hinge structure free from such a pin gets one member coupled with the other by inserting one member into the other laterally, and gets one member decoupled from the other by moving one member upward or laterally for leaving it from the other. Thus, coupling and decoupling are troublesome.

In the case of a conventional frame such as a picture frame for holding an exhibited object to be taken out by pivotally rotating at an engaged portion, the lock mechanism is usually protruded outside the back face, etc. of the picture frame, etc., and can often be unlocked by careless contact. In the case of a conventional frame with the lock mechanism not protruded outside but embedded in the engaged portion of a fastener or frame member, the lock mechanism must be actuated by a separate tool with a sharp tip such as a screw-driver.

The stand to support a rather small picture frame, etc. kept inclined is a support rod pivotably installed to a fixing portion provided almost at the center on the back sheet of the picture frame, etc., for supporting the picture frame, etc. at a proper angle from the back side. As for the hanger, an annular member is held by a folded metallic piece, etc. on the back side of a frame, and the metallic piece is fixed to the frame by screws, etc. for hanging with a string passed through the hole of the annular member. These auxiliary devices are valuable when used for the respectively intended applications, but remain wasteful when not used.

Furthermore, driving fasteners such as nails into a wall to have plural picture frames, etc. exhibited, or spreading linear members across or letting rod members stand against something, for separately fastening plural picture frames, etc. is troublesome and requires enormous labor. In addition, usual walls, etc. to have these picture frames, etc. exhibited are beautifully finished decorative boards, glossy concrete walls, walls lined with marble, etc., glass faces, etc., and it is mostly impossible to drive fasteners such as nails at short intervals. Therefore, a large-scale base, etc. must be used.

Retainers used for retaining the back sheet of a picture frame, etc. containing a transparent sheet, an exhibited object and the back sheet are rotatably installed by nails, etc. at almost the centers of the respective frame members, and rotated to keep the back sheet held and fixed. A reinforcing member is required for preventing the deformation of a large-sized frame such as poster frame, to complicate the mechanism and to raise the cost. Since these are installed to cover the back sheet, the exhibited object, etc. cannot be easily taken in and out, and this work is time-consuming. Therefore, the auxiliary devices for the conventional picture frames, etc. are installed for the respective purposes, and the users must select the picture frames, etc. suitable for their purposes.

SUMMARY OF THE INVENTION

Means for Solving the Problems

In the present invention, an axial member which consists of a pivotal portion provided at the base edge of an axial blade of the axial member, a disengaging protrusion provided at the tip edge of the axial blade, a pivotal rotation guide extended from near the disengaging protrusion, with the pivotal portion as the center of rotation, and an engaging extension provided at the tip edge of the pivotal rotation guide is engaged pivotably and detachably with an axial member support which consists of an opening A formed in it, a pivotal portion rest formed on one side face of the opening, to be engaged with the pivotal portion, an engagement rest formed on the other side face opposite to said one side face, to be engaged with the disengaging protrusion or the engaging extension by the pivotal rotation of the axial member, and a curvature formed along the circumference of the pivotal rotation guide from the engagement rest to said one side face with the pivotal portion rest formed. The axial member and the axial member support can be variously varied for various applications.

Objects of the Invention

The diversification of life style incorporates hinge structures in many applications, and especially demands any hinge structure allowing two pivotable members to be easily coupled with or decoupled from each other without using any tool, etc. The present invention has been completed to respond to this demand, and furthermore presents a lock member and auxiliary devices to be attached to the hinge structure.

An object of the present invention is to present a hinge structure in which an axial member and an axial member support can be pivotably coupled or decoupled from each other, without vertical or horizontal inserting action, but by moving either of the members from front for coupling.

Another object of the present invention is to present a hinge structure with lock mechanisms, in which two axial member supports as adjacent frame members of a picture frame, etc. hold an exhibited object, etc. and are fastened by a fastener such as a corner fastener with lock mechanisms not exposed outside and capable of being easily locked and unlocked by a human finger, etc., and therefore which looks smart.

A further other object of the present invention is to allow the production of differently sized picture frames, etc. by using axial member supports as frame members with a predetermined sectional form and lengths suitable for each exhibited object and the transparent sheet and back sheet to be overlapped on the exhibited object. A still further other object of the present invention is to present auxiliary devices suitable for various applications, which can be mounted on picture frames, etc. of any sizes as required, such as an auxiliary device capable of supporting a picture frame, etc. kept inclined, an auxiliary device capable of keeping an exhibited object, etc. in position by retaining from the back, an auxiliary device for reinforcing a frame, auxiliary devices capable of setting a picture frame, etc. on standards such as rod members, an auxiliary device mounted on a frame to allow it to be hung using a string, etc., an auxiliary device capable of connecting two adjacent picture frames, etc. back to back, side by side or at right angles, for easy exhibition as a pair. It is also an object of the present invention to present highly general purpose auxiliary members which can be rationally and easily mounted on frames of any sizes as required.

DETAILED DESCRIPTION OF THE INVENTION

The present invention is described below in detail in reference to drawings showing respective embodiments. The present invention relates to hinge structures consisting of an axial member and an axial member support, in detail, hinge structures for pivotably and detachably coupling two members such as a housing and a door, a container and a lid, an apparatus and a controller, an apparatus and a display, etc.

FIG. 1 is a partially cutaway perspective view showing a first embodiment. FIG. 2 is a sectional view showing an essential portion of the first embodiment. The drawings show a hinge structure consisting of an axial member 1 or 1A and an axial member support 2 or 2A, comprising a pivotal portion 11, being provided at the base edge of an axial blade 12 of the axial member 1 or 1A; a disengaging protrusion 15, being provided at the tip edge of the axial blade 12; a pivotal rotation guide 13 with the pivotal portion 11 as the center of rotation, being extended from near the disengaging protrusion 15; an engaging extension 18, being provided at the tip edge of the pivotal rotation guide 13; an opening A, being formed in the axial member support 2 or 2A; a pivotal portion rest 22 to be engaged with the pivotal portion 11, being formed on one side face of the opening A; and an engagement rest 24 to be engaged with the disengaging protrusion 15 or the engaging extension 18 by the pivotal rotation of the axial member 1 or 1A, being formed on the other side face opposite to said one side face.

In the first embodiment of FIG. 1, in the axial member 1 or 1A, the pivotal portion 11 has a pivotal portion projection 11*a* formed at the base edge of the axial blade 12, and the disengaging protrusion 15 is formed at the tip edge of the axial blade 12. And the pivotal rotation guide 13 like a circular arc with the pivotal portion 11 as the center of rotation is extended from near the disengaging protrusion 15 with a narrow width at the tip edge of the axial blade 12, and the engaging extension 18 extending outward is formed at the tip edge of the pivotal rotation guide 13. The engaging extension 18 can also be a support in a door, etc.

At both the edges of the pivotal rotation guide 13, feed slopes 16 and 17 are formed to be flat out of the circular arc of the pivotal rotation guide 13, for allowing stable engagement by somewhat relaxing the resiliency caused to act between the pivotal portion rest 22 and the engagement rest 24 of the axial member support 2 or 2A, and the engaging extension 18 has plural small holes 25 formed to allow installation on another member such as a door. Furthermore, in the almost fan-shaped space B between the pivotal rotation guide 13 and the axial blade 12, reinforcing ribs 14 are provided at proper portions, to give auxiliary rigidity to leaf spring resiliency.

The axial member support 2 or 2A has the rectangular opening A with a width and length to allow the axial member 1 or 1A to be fitted, and the illustrated opening A has the pivotal portion rest 22 formed to be engaged with the pivotal portion 11 in the longitudinal direction on one side face, and has the engagement rest 24 to be engaged with the disengaging protrusion 15 or the engaging extension 18 of the axial member 1 or 1A by the pivotal rotation of the axial member 1 or 1A around the pivotal portion 11 by an angle of about 90 degrees, on the other side face opposite to said one side face with the pivotal portion rest 22 formed.

On said one side face of the rectangular opening A, a groove is formed between engagement walls 21 and 23, as the pivotal portion rest 22 to be engaged with the pivotal portion 11, and on the other side face, the engagement rest 24 is formed as a protruded plate. The axial member support 2 or 2A has plural small holes 25 formed above and below the opening A, to allow installation on another member.

If the axial member 1 or 1A is inserted into the opening A of the axial member support 2 or 2A, leading the disengaging protrusion 15 at the tip edge of the axial blade 12, then the axial blade 12 and the pivotal rotation guide 13 contact both the sides of the opening A somewhere in the way for insertion, and if it is further inserted, the space B between the axial blade 12 and the pivotal rotation guide 13 is narrowed by resiliency, for finally allowing the engaging extension 18 to contact the engagement rest 24 of the axial member support 2 or 2A and allowing the pivotal portion projection 11*a* of the pivotal portion 11 of the axial member 1 or 1A to be engaged with the pivotal portion rest 22 of the axial member support 2 or 2C. Thus, the axial member 1 or 1A and the axial member support 2 or 2A are pivotably coupled.

With the axial member 1 or 1A and the axial member support 2 or 2A coupled, the pivotal portion rest 22 is engaged with the pivotal portion projection 11*a* of the pivotal portion 11 and acts as a pivot for the pivotal rotation of the axial member 1 or 1A. If the engaging extension 18 of the axial member 1 or 1A is pulled toward the operator, the disengaging protrusion 15 is pivotally rotated till it contacts the engagement rest 24 on the other side face of the axial member support 2 or 2A, to stop, while the pivotal rotation guide 13 is always kept in contact with the side edge of the axial member support 2 or 2A by resiliency.

To decouple the axial member 1 or 1A from the axial member support 2 or 2A, the axial blade 12 and the pivotal rotation guide 13 of the axial member 1 or 1A can be held and squeezed from both sides, to narrow the space B between the axial blade 12 and the pivotal rotation guide 13, and drawn out of the opening A, for easy decoupling. The axial dislocation between the axial member 1 or 1A and the axial member support 2 or 2A is prevented since both the sides of the opening A in the axial direction form dislocation preventive counter-portions 20 and 20 in contact with the axial dislocation preventive portions 19 and 19 of the axial blade 12 and the pivotal rotation guide 13 of the axial member 1 or 1A.

FIG. 3 is a sectional view showing an essential portion of another example of FIG. 2. In this example, said one side face of the opening A of the axial member support 2B to have the axial member 1A inserted and pivotably coupled is formed by three plates. That is, the engagement walls 21 and 23 and the grooved pivotal portion rest 22*a* are formed by overlapping and bonding three differently wide plates to form the groove at one end.

FIG. 4 is a partially cutaway perspective view showing another example of the first embodiment. The axial member support 2C is formed as a plate bent at both the ends in the axial direction of the opening A to form a U shape with the opening A, with a cutout 21V formed on one side face of the opening A, and the engagement wall 23 is formed integrally or separately inside the cutout 21V, and with the grooved pivotal portion rest 22*a* formed beside the engagement wall 23.

The flat portions on both sides of the opening A of the bent axial member support 2C form the dislocation preventive counter-portions 20*a* and 20*a* to be engaged with the dislocation preventive portions 19*a* and 19*a* of the axial member 1A, for preventing the axial dislocation. The cutout 21V is formed for allowing the axial member 1A to be decoupled from the axial member support 2C, by inserting the tip blade of a screwdriver, etc. into the clearance between the pivotal portion 11 of the axial member 1A and the pivotal portion rest 22*a* of the axial member support 2C coupled with each other.

As another decoupling means, though not illustrated, the engagement rest 24 on the other side face of the axial member support 2C can be structurally made movable, to be able to partially move outside the pivotal portion 11 using a spring or screw, etc. without colliding with the disengaging protrusion tip 15*a* at the tip of the disengaging protrusion 15A of the axial member 1A.

FIG. 5 is a partially cutaway perspective view showing a further other example of the first embodiment. The axial member support 2D is a hollow cubic body with the opening A formed in one side wall. The pivotal portion rest 22 is provided on one side edge of the opening, and both the end faces in the axial direction of the cubic body form the dislocation preventive counter-portions 20*b* and 20*b* to prevent the axial dislocation, and the dislocation preventive counter-portions 20*b* and 20*b* have small holes 25 for connection to another member.

FIG. 6 is a cross sectional view showing an essential portion of a second embodiment of the present invention. This embodiment is a hinge structure consisting of an axial member 1B and an axial member support 2E, comprising a pivotal portion 11, being provided at the base edge of an axial blade 12 of the axial member 1B; a disengaging protrusion 15, being provided at the tip edge of the axial blade 12; a pivotal rotation guide 13 with the pivotal portion 11 as the center of rotation, being extended from near the disengaging protrusion 15; an engaging extension 18, being provided at the tip edge of the pivotal rotation guide 13; an opening A, being formed in the axial member support 2E; a pivotal portion rest 22*b* to be engaged with the pivotal portion 11, being formed on one side face of the opening A; an engagement rest 24 to be engaged with the disengaging protrusion 15 or the engaging extension 18 by the pivotal rotation of the axial member 1B, being formed on the other side face opposite to said one side face; and a curvature 29, being formed along the circumference of the pivotal rotation guide 13 from the engagement rest 24 to said one side face with the pivotal portion rest 22*b* formed.

In the second embodiment, the axial member is resilient, but the axial member support can also be resilient. Since the axial member 1B is almost the same as that of the first embodiment, it is not described in detail here. However, in the second embodiment, the pivotal portion 11 at the base edge of the axial blade 12 can be flat.

The axial member support 2E is also almost the same, but the curvature 29 along the circumference of the pivotal rotation guide 13 of the axial member 1B is formed from the engagement rest 24*a* to the one side face with the pivotal portion rest 22*b* formed.

Furthermore, the engagement wall 21 is formed by inwardly curving the one side face of the axial member support 2E at the edge of the opening A and the engagement wall 23*a* is formed to protrude with a slight clearance against the engagement wall 21, to form the pivotal portion rest 22*a* with a width corresponding to the slight clearance. Said one side face rises straight from the engagement wall 23*a* upward, and the curvature 29 along the circumference of the pivotal rotation guide 13 of the axial member 1B is formed from the base end of said one side face and is inwardly bend at the other end, to form the engagement rest 24*a*.

The axial member support 2E with the sectional structure of this embodiment can be molded by extrusion molding, etc. as a product with a continuously molded length in the axial direction. So, it can easily assure uniform pivotal rotation as a hinge structure with a long axis. The axial member 1B is inserted into the opening A of the axial member support 2E, to have the pivotal portion 11 engaged with the pivotal portion rest 22*b*, for pivotable coupling. In this case, pivotal rotation is effected while the tip of the disengaging protrusion 15 of the axial member 1B contacts the curvature 29 of the axial member support 2E, and while the external face of the curved pivotal rotation guide 13 of the axial member 1B contacts the tip of the engagement rest 24*a* of the axial member support 2E.

Therefore, since the axial member 1B can be pivotally rotated with a more sliding face area, the rotation resistance force for pivotal rotation can be intentionally adjusted.

FIG. 7 is a partially cutaway perspective view showing another example of the second embodiment. In the axial member 1B of the second embodiment shown in FIG. 6, a reinforcement 14*d* is provided from the axial blade 12 to the other edge of the pivotal rotation guide 13, and the axial member support 2F as a block is cut out on one side of the block, to form the opening A, together with the engagement walls 21 and 23 and the pivotal portion rest 22 on one side face of the opening A and the engagement rest 24 on the other side face of the opening A, thereby forming the curvature 29 continuous from the engagement rest 24.

Furthermore, the dislocation preventive counter-portions 20*c* and 20*c*' as flat plates with the small holes 25 are installed on both sides of the axial member support 2F by tightening bolts or screws, etc. through the small holes 25. The flat plates 20*c* and 20*c*' can also be molded integrally with the axial member support 2F.

FIG. 8 is a perspective view showing the embodiment illustrated in FIG. 6. The axial member 1D and the axial member support 2G are formed to be longer in the axial direction. This embodiment can very easily provide a hinge structure of, say, more than 5 meters.

FIGS. 9 and 10 are perspective views showing how the second embodiment is used. The axial member 1D is installed at the opening edge of an apparatus housing 8*a*, and the axial member support 2G is installed in a door 7*a*, etc. for pivotable coupling, so that the door 7*a*, etc. can be opened and closed. In this case, the dislocation preventive portion 20 for preventing the axial dislocation is provided at the bottom.

FIG. 11 is a partially cutaway perspective view showing a third embodiment of the present invention. This embodiment is a hinge structure consisting of an axial member 1E which has a pivotal portion 11 provided at the base edge of an axial blade 12 of the axial member 1E, a disengaging protrusion 15 provided at the tip edge of the axial blade 12, a pivotal rotation guide 13 with the pivotal portion 11 as the center of rotation, extended from near the disengaging protrusion 15, and an engaging extension 18 provided at the tip edge of the pivotal rotation guide 13, and an axial member support 2H which has an opening A, a pivotal portion rest 22 to be engaged with the pivotal portion 11, formed on one side face of the opening A, an engagement rest 24 to be engaged with the disengaging protrusion 15 or the engaging extension 18 by the pivotal rotation of the axial member 1E, formed on the other side face opposite to said one side face, and a curvature 29 formed along the circumference of the pivotal rotation guide 13 from the engagement rest 24 to said one side face with the pivotal portion rest 22 formed; comprising dislocation preventive portions 19*d* to prevent the dislocation in the axial direction, being formed on the curvature of the pivotal rotation guide 13 of the axial member 1E; and dislocation preventive counter-portions 20*d* or 20*e*, being formed at the positions agreeing with the dislocation preventive portions 19*d* on the curvature 29 of the axial member support 2H.

That is, the plural recessed or protruded dislocation preventive portions 19*d* are formed in the axial member 1E crosswise from the axial blade 12 with the pivotal portion 11 and the disengaging protrusion 15 at both the edges to the pivotal rotation guide 13 extended like a circular arc with the pivotal portion 11 as the center of rotation, and the pivotal rotation guide 13 is bent at the tip edge, to form the engaging extension 18.

On the other hand, the axial member support 2H shaped like a U letter in cross section is bent inwardly at both the edges, to form the opening A, the engagement wall 21 and the engagement rest 24. Beside the engagement wall 21, the engagement wall 23 is formed with the pivotal portion rest 22 formed between the engagement walls 21 and 23, and in the space between the engagement wall 21 and the engagement rest 24, the curvature 29 along the circular arc of the pivotal rotation guide 13 of the axial member 1E is formed. On the curvature 29, plural protruded or recessed dislocation preventive counter-portions 20*d* are formed at positions agreeing with the dislocation preventive portions 19*d* formed in the pivotal rotation guide 13.

In the axial member support 2H of this embodiment, a member shaped like a U letter in cross section with the opening A and a spacer 5*a* as another member are used to form the curvature 29, and the dislocation preventive counter-portions 20*d* are formed on the curvature 29. The spacer 5*a* and the member shaped like a U letter in cross section with the opening A are integrally fastened to each other using an adhesive or engagement claws, etc.

FIG. 12 is a perspective view showing a spacer 5*b* as another example of the spacer of FIG. 11. The spacer 5*b* as a plate is formed to be flat on one side and like a circular arc on the other side to form the curvature 29*b*, and pairs of parallel slits are formed to let the portions demarcated by the respective pairs of slits swell inside, for forming the dislocation preventive counter-portions 20*d*'.

FIG. 13 is a perspective view showing an essential portion of a spacer 5*c* as a further other example of the spacer. The spacer 5*c* as a plate is formed to have the pivotal portion rest 22 and the engagement wall 23 on one side and the curvature 29*c* like a circular arc on the other side, and on the curvature 29*c*, pairs of parallel slits are formed to let the portions demarcated by the respective pairs of slits swell inside, for forming the dislocation preventive counter-portions 20*d*".

Moreover, FIG. 14 is a perspective view showing a spacer 5*d* like the axial member support 2H as a still further other example. The spacer 5*d* as a plate is formed to be flat on one side, and like a circular arc on the other side to form the curvature 29*b* and the opening A. On the curvature 29*b*, pairs of parallel slits are formed, to let the portions demarcated between the respective pairs of slits swell inside, for forming the dislocation preventive counter-portions 20*d*"'. The flat portion is bent inwardly at the edge, to form the engagement wall 21 and the circular arc portion is bent at the edge, to form the engagement rest 24.

FIGS. 15 and 16 are perspective views showing how a still further other example is used. In the axial member 1F, the axial blade 12 is provided with the pivotal portion 11 and the disengaging protrusion 15 at both the edges, and the pivotal rotation guide 13 extended from the axial blade 12 is provided with the dislocation preventive portions 19*d*. On the other hand, the axial member support 2J as a plate is formed to be flat on one side with the engagement walls 21 and 23 formed on both sides of the pivotal portion rest 22, and to have the curvature 29*e* formed like a circular arc on the other side. On the curvature 29*e*, the dislocation preventive counter-portion 20*e* is formed along the curvature 29*e*.

A door 7*b* has the engaging extension 18 of the axial member 1F fastened, and the axial member 1F is inserted into the opening A of the axial member support 2J for pivotable coupling. Then, the axial member support 2J is fastened to a main body **8*b*. It is also possible to assemble the coupled axial member and axial member support into the main body 8*b*, together with the assembled door 7*b***.

A fourth embodiment is described below in reference to the sectional view of FIG. 17 showing an essential portion and the partially cutaway perspective view of FIG. 18. The fourth embodiment is a hinge structure consisting of an axial member 1G which has a pivotal portion 11 provided at the base edge of an axial blade 12 of the axial member 1G, a pivotal rotation guide 13 with the pivotal portion 11 as the center of rotation, provided at the tip edge of the axial blade 12, and an engaging extension 18 provided at the tip edge of the pivotal rotation guide 13, and an axial member support 2K which has an opening A, a pivotal portion rest 22 to be engaged with the pivotal portion 11, formed on one side face of the opening A, an engagement rest 24 to be engaged with the engaging extension 18 by the pivotal rotation of the axial member 1G, formed on the other side face opposite to said one side face, and a curvature 29 formed along the circumference of the pivotal rotation guide 13 from the engagement rest 24 to said one side face with the pivotal portion rest 22 formed; comprising said engaging extension 18 of the axial member 1G, being extended from a first housing **7*c*, and the engagement rest 24 of the axial member support 2K, being extended from a second housing 8*c***.

In the embodiment of FIGS. 17 and 18, the axial member 1G and the axial member support 2K are formed as respective parts of the first housing **7*c* and the second housing 8*c*. That is, the engaging extension 18 of the axial member 1G is a part of the first housing 7*c*, and the engagement rest 24 of the axial member support 2K is a part of the second housing 8*c***.

The pivotal rotation between the axial member 1G and the axial member support 2K can be stopped when the wall 101 of the first housing **7*c* collides with the wall 201 of the second housing 8*c***.

In the illustrated embodiment, the engagement walls 21 and 23 and the pivotal portion rest 22 between them of the axial member support 2K are formed as a separate part which is installed in the second housing **8*c***, but the part can also be formed integrally.

FIG. 19 is a partially cutaway perspective view showing another example of the fourth embodiment. The axial member 1H is integrally formed with the second housing **7*d*. In this case, the second housing 7*d* is formed to rise like a circular arc on one side of the housing, to form the pivotal rotation guide 13 with a curved surface, and the pivotal rotation guide 13 is provided with the disengaging protrusion 15, the axial blade 12 and the pivotal portion 11** respectively.

On the other hand, the first housing **8*d* is cut out at an edge, to form the opening A, and the engagement walls 21 and 23 are formed together with the pivotal portion rest 22, on one side face of the opening A, while the engagement rest 24 is formed on the other side face, to form the axial member support 2L**.

The axial member 1H is inserted from front into the opening A of the axial member support 2L for pivotable coupling.

FIG. 20 is a partially cutaway perspective view showing a still further other example of the present invention. The axial member support 2M formed as a rectangular plate has the opening A at the center. On one side face of the opening A, many protruded small engagement walls 21 are formed in the front, and many protruded small engagement walls 23 are formed in the rear, to form the pivotal portion rest 22 between the respective engagement walls 21 and 23. The top and bottom faces of the openings act as the dislocation preventive counter-portions 20, and the axial member support 2M has the small holes 25 formed at portions above and below the opening A for installation onto another member.

The axial member used for this example is the axial member 1 of the first embodiment shown in FIGS. 1 to 5.

FIG. 21 is a sectional view showing an essential portion of a fifth embodiment. This embodiment is a hinge structure consisting of an axial member 1I and an axial member support 2N, comprising a pivotal portion 11, being provided at the base edge of an axial blade **12*a* of the axial member 1I; a pivotal rotation guide 13 formed as a flat plate mounted with a curved panel 13*a* with the pivotal portion projection 11*a* of the pivotal portion 11 as the center of rotation, being provided at the tip edge of the axial blade 12*a*; a disengaging protrusion 15, being provided at the base edge of the pivotal rotation guide 13 formed as a flat plate; an engaging extension 18, being provided at the tip edge of the pivotal rotation guide 13 formed as a flat plate; the pivotal rotation guide 13 formed as a flat plate, being provided with plural holes for mounting by fasteners 33; an opening A, being formed in the axial member support 2N; a pivotal portion rest 22 to be engaged with the pivotal portion 11, being formed on one side face of the opening A; and an engagement rest 24 to be engaged with the disengaging protrusion 15 or the engaging extension 18 by the pivotal rotation of the axial member 1I**, being formed on the other side face opposite to said one side face.

In the embodiment of the present invention illustrated in FIG. 21, the pivotal rotation guide 13 of the axial member 1I is formed as a flat plate, and the engaging extension 18 is extended from the flat plate at an angle. The plate has holes drilled at upper and lower portions and is bent outward at the tip, to form the disengaging protrusion 15. The upper holes are used to install the curved panel **13*a* provided as a separate part, and the lower holes are used to detachably fasten the metallic leaf spring 12*a* used as the axial blade 12 provided as a separate plate, using fasteners 33, with the pivotal portion 11** formed at the tip.

In the illustration, the pivotal portion projection **11*a* is formed from the pivotal portion 11**.

FIG. 22 shows another example of the fifth embodiment. The pivotal rotation guide 13 of the axial member 1J is formed as a flat plate on the back, and the engaging extension 18 is extended from the flat plate at an angle. The plate has holes drilled at upper and lower positions, and is bent outward at the tip, to form the disengaging protrusion 15. The upper holes are used to detachably fasten the metallic leaf spring **12*b* used as the axial blade 12 provided as a separate part, using fasteners 33, and the lower holes are used to install the curved panel 13*b* provided as a separate part. In addition, the leaf spring 12*b* has other holes drilled, and the engagement wall 23 protruded from the axial member support 2N is inserted into the holes, to prevent that the pivotal portion 11 at the tip edge of the leaf spring 12*b* comes off from the pivotal portion rest 22**.

FIG. 23 is a sectional view showing an essential portion of a further other example of the fifth embodiment. In this example, the axial member 1K can be pivotably coupled with the axial member support 2P without making the axial member **1*k* act resiliently. Also in this case, the axial member 1K is inserted into the opening A of the axial member support 2P, for pivotable coupling. The pivotal rotation guide 13 of the axial member 1K is formed to be a flat plate on the back, and the engaging extension 18 is extended from the flat plate at an angle. Furthermore, the pivotal rotation guide 13 provided as a flat plate is extended and folded back to its back side, to form the axial blade 12, and has holes drilled through the pivotal rotation guide 13 formed as a flat plate and the axial blade 12 along an upper line, and also holes drilled through the pivotal rotation guide 13 only along a lower line. The upper holes are used to fasten the axial blade 12 and the pivotal rotation guide 13 by fasteners 33, and the lower holes are used to detachably install the curved panel 13***c* provided as a separate part.

At the bonding face between the curved panel 13*c* provided as a separate part and the pivotal rotation guide 13, resilient finger grips 31 are protruded and inserted into the lower holes. The curved panel 13*c* can be easily removed by squeezing the finger grips 31.

FIG. 24 is a sectional view showing an essential portion of a still further other example of the fifth embodiment. It is a modification of the axial member 1K. The axial member 1*k*' has protrusions at the bonding face between the curved panel 13*d* and the pivotal rotation guide 13, and the protrusions are inserted through the lower holes for fastening them. On one side wall of the opening A of the axial member support 2Q, the engagement wall 21 and the pivotal portion rest 22 are detachably installed by bolts and nuts 26, so that the axial member 1K' and the axial member support 2Q can be easily decoupled from each other by removing the bolts and nuts 26 and drawing the axial member 1K' from the opening A.

The fifth embodiment of the present invention is especially suitable for use as a hinge structure for a pivot with a heavy member such as a door.

FIG. 25 is a sectional view showing an essential portion of a sixth embodiment. This embodiment is a hinge structure consisting of an axial member 1L which has a pivotal portion 11 provided at the base edge of an axial blade 12 of the axial member 1L, a pivotal rotation guide 13*f* with the pivotal portion 11 as the center of rotation, provided at the tip edge of the axial blade 12, a disengaging protrusion 15 provided at the tip edge of the pivotal rotation guide 13*f*, and an engaging extension 18 provided at the tip edge of the pivotal rotation guide 13*f*, and an axial member support 2R which has an opening A, a pivotal portion rest 22 to be engaged with the pivotal portion 11, formed on one side face of the opening A, an engagement rest 24 to be engaged with the disengaging protrusion 15 or the engaging extension 18 by the pivotal rotation of the axial member 1L, formed on the other side face opposite to said one side face, and a curvature 29*f* formed along the circumference of the pivotal rotation guide 13*f* from the engagement rest 24 to said one side face with the pivotal portion rest 22 formed; comprising the sliding contact face of the pivotal rotation guide 13*f* of the axial member 1L, being different in the coefficient of friction from that of the curvature 29*f* of the axial member support 2R.

That is, the sliding contact face of the pivotal rotation guide 13 of the axial member 1L and that of the curvature 29*f* of the axial member support 2R are made of materials different in the coefficient of friction. In this case, the axial blade 12 and the leaf spring 12*f* keep the sliding contact face 29*f* and the pivotal rotation guide 13*f* into pressure contact with the disengaging protrusion 15 and the engagement rest 24 respectively, so that the rotation torque between the axial member 1L and the axial member support 2R, irrespective of strip torque or lock torque, can be controlled. So, the hinge structure can be used for a pivotable damper.

FIG. 26 is a sectional view showing an essential portion of a seventh embodiment, and FIG. 27 is a perspective view showing its axial member. This embodiment is a hinge structure consisting of an axial member 1M which has a pivotal portion 11 provided at the base edge of an axial blade 12 of the axial member 1M, a pivotal rotation guide 13 with the pivotal portion 11 as the center of rotation, extended from near the tip edge of the axial blade 12, and an engaging extension 18 provided at the tip edge of the pivotal rotation guide 13, and an axial member support 2G which has an opening A, a pivotal portion rest 22 to be engaged with the pivotal portion 11, formed on one side face of the opening A, an engagement rest 24 to be engaged with the engaging extension 18 by the pivotal rotation of the axial member 1M, formed on the other side face opposite to said one side face, and a curvature 29 formed along the circumference of the pivotal rotation guide 13 from the engagement rest 24 to said one side face with the pivotal portion rest 22 formed; comprising a cutout 34, being formed by partially cutting out the axial blade 12 and the pivotal rotation guide 13 respectively of the axial member 1M; a flat portion 35, being formed as the bottom of the cutout 34; and a resilient spring 3 with a bottom face in contact with the flat portion 35 and a disengaging protrusion 15K formed, being mounted.

In this embodiment, the pivotal rotation guide 13 rising like a circular arc from the engaging extension 18 of the axial member 1M has the cutout 34 formed at the center, and the flat portion 35 is formed as the bottom of the cutout 34. The pivotal rotation guide 13 also has feed slopes 16*a* and 17*a* formed on both sides of the cutout 34.

FIG. 29 is a perspective view showing the resilient spring 3 of FIG. 26. This embodiment uses the resilient spring 3 on the flat portion 35 of the axial member 1M, instead of the disengaging protrusion 15 used in the above mentioned respective embodiments. The resilient spring 3 is an almost V-shaped plate with its both ends bent outward.

One of the bent portions is used as an engagement claw 3K, and the other bent portion is folded back, to form the disengaging protrusion 15*k*. With the resilient spring 3 squeezed, the disengaging protrusion 15*k* is inserted into the engagement rest 24 formed on the other side face the opening A of the axial member support 2G, while the pivotal portion 11 of the axial blade 12 of the axial member 1M is inserted into the pivotal portion rest 22 formed on the one side wall of the axial member support 2G, in order that the disengaging protrusion 15*k* may be fitted into the curvature 29 of the axial member support 2G, to achieve pivotable coupling.

If the disengaging protrusion 15*k* of the resilient spring 3 is pressed downward, the axial member 1M can be easily decoupled from the axial member support 2G, and the axial member 1M can be easily removed from the opening A of the axial member support 2G.

FIG. 28 is a perspective view showing another example of FIG. 27. The axial member iN has a rising resilient spring 3*m* instead of the flat portion 35 of the axial member 1M shown in the example illustrated in FIGS. 26 and 27. The resilient spring 3*m* is bent outward at the tip, to form the disengaging protrusion 15*m*. This example has the disengaging protrusion 15*m* more narrow than the disengaging protrusion 15 of the axial member 1L of the sixth embodiment, and but is not described here in more detail.

FIGS. 30 and 31 are sectional views showing an essential portion of an eighth embodiment. FIG. 32 is a perspective view showing the resilient spring. This embodiment is a hinge structure consisting of an axial member 1P which has a pivotal portion 11 provided at the base edge of an axial blade 12 of the axial member 1P, a pivotal rotation guide 13 with the pivotal portion 11 as the center of rotation, extended from near the tip edge of the axial blade 12, and an engaging extension 18 provided at the tip edge of the pivotal rotation guide 13, and an axial member support 2G which has an opening A, a pivotal portion rest 22 to be engaged with the pivotal portion 11, formed on one side face of the opening A, an engagement rest 24 to be engaged with the engaging extension 18 by the pivotal rotation of the axial member 1P, formed on the other side face opposite to said one side face, and a curvature 29 formed along the circumference of the pivotal rotation guide 13 from the engagement rest 24 to said one side face with the pivotal portion rest 22 formed; comprising a cutout 34, being formed by partially cutting out the axial blade 12 and the pivotal rotation guide 13 respectively of the axial member 1P; a flat portion 35, being formed as the bottom of the cutout 34; and an L-shaped resilient spring 3 with a bottom face in contact with the flat portion 35 and a disengaging protrusion 15 formed, being detachably mounted through a detaching mechanism.

In this embodiment, the flat portion 35 of the axial member 1M in the seventh embodiment of FIG. 26 has a hole 3P drilled, and the resilient spring 3 with a flat face to suit the flat portion 35 is formed like an L letter and has a hole 3P' drilled on the flat face to suit the hole 3P, and has a pushbutton mounted as the detaching mechanism 4, in the axial member 1P.

In this embodiment, if the pushbutton as the detaching mechanism 4 is pressed in, the disengaging protrusion 15 of the resilient spring 3 contacts the curvature 29 of the axial member support 2G, to make the axial member 1P coupled with the axial member support 2G.

The axial member 1P can be decoupled from the axial member support 2G, simply by removing the pushbutton as the detaching mechanism 4.

FIG. 33 is a partially cutaway perspective view showing a ninth embodiment, and FIG. 34 is a sectional view showing an essential portion of the embodiment. This embodiment is a hinge structure consisting of an axial member 1Q which has a pivotal portion 11 provided at the base edge of an axial blade 12 of the axial member 1Q, a pivotal rotation guide 13 with the pivotal portion 11 as the center of rotation, provided at the tip edge of the axial blade 12, a disengaging protrusion 15 provided at the base edge of the pivotal rotation guide 13, and engaging extensions **18*a* and 18*b* provided at the tip edge of the pivotal rotation guide 13, and an axial member support 2S which has an opening A, a pivotal portion rest 22 to be engaged with the pivotal portion 11, formed on one side face of the opening A, an engagement rest 24 to be engaged with the disengaging protrusion 15 or the engaging extensions 18*a* and 18*b* by the pivotal rotation of the axial member 1Q, formed on the other side face opposite to said one side face, and a curvature 29 formed along the circumference of the pivotal rotation guide 13 from the engagement rest 24 to said one side face with the pivotal portion rest 22 formed; comprising many undulations, being formed on the curved surface with the pivotal portion 11 as the center of rotation, of the pivotal rotation guide 13 of the axial member 1Q; a recess 32, being formed at the base edge of the pivotal rotation guide 13; and a disengaging protrusion attachment 15*a*, being fit in the recess 32**.

In this embodiment, the axial member 1Q is provided with two engaging extensions **18*a* and 18*b* apart from each other, to have another member fastened between them. At their ends on the other side, they are connected with each other, and a circular arc with the pivotal portion 11 as the center of rotation rises from the connection, to form the pivotal rotation guide 13 with a curved surface. On the curved surface of the pivotal rotation guide 13, many protrusions are formed at equal intervals, and under the pivotal rotation guide 13, the axial blade 12 is extended with the pivotal portion 11** at its tip.

On the other hand, the axial member support 2S has the opening A, and on one side wall of the opening A, the engagement walls 21 and 23 are formed, with the pivotal portion rest 22 formed between the engagement walls 21 and 23. On the other side face of the opening A, the engagement rest 24 is formed to protrude a little, and the curvature 29 along the circumference of the pivotal rotation guide 13 is formed from the engagement rest 24 to the one side face with the pivotal portion rest 22 formed. In this embodiment, the axial member support 2S has a pin 6, and a pin cover 30 acts to arrest the pin 6 in the axial direction and to give decorative appearance. The pin 6 is held and horizontally pivotally rotated.

The undulations formed at equal intervals on the pivotal rotation guide 13 are intended to positively arrest the axial member support 2S or the axial member 1Q by inserting the engagement rest 24 into one of the recesses provided at equal intervals.

FIG. 35 is a partially cutaway perspective view showing a further other example of the second embodiment. On the axial blade 12 provided with the pivotal portion 11 and the disengaging protrusion 15, the pivotal rotation guide 13 is formed like a circular arc with feed slopes 16 and 17 on both sides, and the pivotal rotation guide 13 is provided with reinforcements 14 on both sides, and is bent at the tip, to form the engaging extension 18 with holes 25 drilled, for constituting the axial member 1R.

The axial member support 2T is formed as a housing shaped like an almost quadrisected cylinder, to have the opening A. On one side face of the opening A, the engagement rest 24 is formed and the curvature 29 is formed like a circular arc from the engagement rest 24. On the other side face of the opening A, the engagement walls 21 and 23 and the pivotal portion rest 22 are formed. Around the opening A of the housing, an installation plate 36 with small holes 25 drilled for installation to another member is extended, and reinforcements 14 are attached for the housing and the installation plate 36.

The axial member 1R is inserted into the opening A of the axial member support 2T from front, for coupling.

FIG. 36 is a perspective view showing a tenth embodiment. This embodiment is a pivotable hinge structure for a picture frame C, etc. with an axial member is used as a fastener and axial member supports **2*u* used as frame members to be coupled with the axial member 1. It is a hinge structure with mechanisms for locking a fastener used as one of corner fasteners or joints for pivotably coupling, at butt joint angles, two pairs of frame members connected to form a rectangle such as a picture frame C. In more detail, it relates to a hinge structure which can pivotably couple frame members with a fastener such as a corner fastener or joint and allows the frame members to be pivotally rotated to close or open the peripheral portions of the exhibited object, for easily setting removing the exhibited object, having lock mechanisms for locking the axial member 1S, 1T, 1U or 1V used as a fastener to the axial member supports 2U** used as frame members.

This embodiment is a hinge structure for a pivotable picture frame C, etc. consisting of an axial member 1S used as a fastener and a pair of axial member supports 2U used as adjacent frame members, comprising a pivotal portion 11, being provided at the base edge of each of a pair of axial blades 12 of the axial member is used as a fastener; a disengaging protrusion 15, being provided at the tip edge of each of the axial blades 12; a pivotal rotation guide 13 with the pivotal portion 11 as the center of rotation, being extended from near each of the disengaging protrusions 15; an engaging extension 18 as the back face of the fastener, being provided at the tip edges of the pivotal rotation guides 13, with a pair of fastener depth portions 18*c* extended toward the back face of an exhibited object, etc. D and with a fastener contact face 18*d* provided in parallel to the engaging extension 18 and in contact with the back face of the exhibited object, etc. D; an opening A, being formed in each of the axial member supports 2U used as frame members; a pivotal portion rest 22 to be engaged with the corresponding pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the corresponding disengaging protrusion 15 or the engaging extension 18 by the pivotal rotation of the axial member 1S, being formed on the other side face opposite to said one side face; a curvature 29, being formed along the circumference of the corresponding pivotal rotation guide 13 from the engagement rest 24 to said one side face with the pivotal portion rest 22 formed; and a pair of lock members 9, being pivotably or slidably provided in the axial member 1S used as a fastener, for locking in such a way that a locking claw 9*b* protruded from the main body 9*a* of each of the lock members 9 may be engaged with the portion immediately below the corresponding engagement rest 24.

FIG. 37 is a perspective view showing an essential portion of an eleventh embodiment, and a perspective showing the lock member, and FIG. 38 is a partially cutaway perspective view of the embodiment. This embodiment is a hinge structure for a pivotable picture frame C, etc. consisting of an axial member 1T used as a fastener and a pair of axial member supports 2U used as adjacent frame members, comprising a pivotal portion 11, being provided at the base edge of each of a pair of axial blades 12 of the axial member 1T used as a fastener; a disengaging protrusion 15, being provided at the tip edge of each of the axial blades 12; a pivotal rotation guide 13 with the pivotal portion 11 as the center of rotation, being extended from near each of the disengaging protrusions 15; an engaging extension 18 as the back face of the fastener, being provided at the tip edges of the pivotal rotation guides 13, with a pair of fastener depth portions 18*c* extended toward the back face of an exhibited object, etc. D and with a fastener contact face 18*d* provided in parallel to the engaging extension 18 and in contact with the back face of the exhibited object, etc. D; an opening A, being formed in each of the axial member supports 2U used as frame members; a pivotal portion rest 22 to be engaged with the corresponding pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the corresponding disengaging protrusion 15 or the engaging extension 18 by the pivotal rotation of the axial member 1T, being formed on the other side face opposite to said one side face; a curvature 29, being formed along the circumference of the corresponding pivotal rotation guide 13 from the engagement rest 24 to said one side face with the pivotal portion rest 22 formed; a pair of cutout spaces 111 with an opening AA respectively, being formed by cutting out the engaging extension 18 as the back face of the axial member 1T used as a fastener and the fastener depth portions 18*c*; a pair of mutually facing pivotal portions 112 of the fastener, being formed in parallel to the fastener depth portion 18*c* below each of the cutout spaces 111; each of a pair of lock members 9, being provided with a locking claw 9*b* protruded horizontally from its main body 9*a* pivotably provided in each of the cutout spaces 111; a pair of pivotal portions 9*c* of each of the lock members 9 to be pivotably engaged with the pivotal portions 112 of the fastener, being formed at the base edge of the main body 9*a* of the lock member 9; and each of a pair of finger action parts 9*d* accessible from the opening AA of the disengaging extension 18 in each of the cutout spaces 111, being formed as the top of the main body 9*a* of the lock member 9.

FIG. 39 is a sectional view showing an essential portion of a twelfth embodiment, and FIG. 40 is a partially breakaway perspective view showing the embodiment. This embodiment is a hinge structure for a pivotable picture frame C, etc. consisting of an axial member 1U used as a fastener and a pair of axial member supports 2U used as adjacent frame members, comprising a pivotal portion 11, being provided at the base edge of each of a pair of axial blades 12 of the axial member 1U used as a fastener; a disengaging protrusion 15, being provided at the tip edge of each of the axial blades 12; a pivotal rotation guide 13 with the pivotal portion 11 as the center of rotation, being extended from near each of the disengaging protrusions 15; an engaging extension 18 as the back face of the fastener, being provided at the tip edges of the pivotal rotation guides 13, with a pair of fastener depth portions 18*c* extended toward the back face of an exhibited object, etc. D and with a fastener contact face 18*d* provided in parallel to the engaging extension 18 and in contact with the back face of the exhibited object, etc. D; an opening A, being formed in each of the axial member supports 2U used as frame members; a pivotal portion rest 22 to be engaged with the corresponding pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the corresponding disengaging protrusion 15 or the engaging extension 18 by the pivotal rotation of the axial member 1U, being formed on the other side face opposite to said one side face; a curvature 29, being formed along the circumference of the corresponding pivotal rotation guide 13 from the engagement rest 24 to said one side face with the pivotal portion rest 22 formed; a pair of cutout spaces 111 respectively with an opening AA, being formed by cutting out the pivotal rotation guides 13 of the axial member 1U used as a fastener and the engaging extension 18 as the back face of the fastener; a pair of mutually facing pivotal portions 112 of the fastener, being formed in parallel to the pivotal rotation guide 13 below each of the cutout spaces 111; each of a pair of lock members 9, being provided with a locking claw 9*b* protruded horizontally from its main body 9*a* pivotably provided in each of the cutout spaces 111; a pair of pivotal portions 9*c* of each of the lock members 9 to be pivotably engaged with the pivotal portions 112 of the fastener, being formed at the base edge of the main body 9*a* of the lock member 9; and each of a pair of finger action parts 9*d* accessible from the opening AA of the disengaging extension 18 in each of the cutout spaces 111, being formed as the top of the main body 9*a* of the lock member 9.

FIG. 41 is a sectional view showing an essential portion of a thirteenth embodiment and a perspective view showing a lock member. This embodiment is a hinge structure for a pivotable picture frame C, etc. consisting of an axial member 1V used as a fastener and a pair of axial member supports 2U used as adjacent frame members, comprising a pivotal portion 11, being provided at the base edge of each of a pair of axial blades 12 of the axial member 1V used as a fastener; a disengaging protrusion 15, being provided at the tip edge of each of the axial blades 12; a pivotal rotation guide 13 with the pivotal portion 11 as the center of rotation, being extended from near each of the disengaging protrusions 15; an engaging extension 18 as the back face of the fastener, being provided at the tip edges of the pivotal rotation guides 13, with a pair of fastener depth portions 18*c* extended toward the back face of an exhibited object, etc. D and with a fastener contact face 18*d* provided in parallel to the engaging extension 18 and in contact with the back face of the exhibited object, etc. D; an opening A, being formed in each of the axial member supports 2U used as frame members; a pivotal portion rest 22 to be engaged with the corresponding pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the corresponding disengaging protrusion 15 or the engaging extension 18 by the pivotal rotation of the axial member 1V, being formed on the other side face opposite to said one side face; a curvature 29, being formed along the circumference of the corresponding pivotal rotation guide 13 from the engagement rest 24 to said one side with the pivotal portion rest 22 formed; a pair of cutout spaces 111 respectively with an opening AA, being formed by cutting out the engaging extension 18 as the back face of the axial member 1V used as a fastener and the fastener depth portions 18*c*; a pair of mutually facing sliding portions 113 of the fastener, being formed at right angles to the fastener depth portion 18*c* below each of the cutout spaces 111; each of a pair of lock members 9, being provided with a locking claw 9*b* protruded horizontally from its main body 9*a* slidably provided in each of the cutout spaces 111; a pair of sliding portions 9*e* of each of the lock members 9 to be slidably engaged with the sliding portions 113 of the fastener, being formed at the base edge of the main body 9*a* of the lock member 9; and each of a pair of finger action parts 9*d* accessible from the opening AA in each of the cutout spaces 111, being formed as the top of the main body 9*a* of the lock member 9.

Any of the tenth to thirteenth embodiments provides a hinge mechanism used for a picture frame, etc. to have an exhibited object such as a picture, photograph or poster, etc. held between a transparent sheet and a back sheet, etc., for hanging on a wall, etc. or placing on a desk, or for decoration. The picture frame, etc. is a rectangular frame consisting of two pairs of parallel frame members fixed at the corners by fasteners such as joints. A hinge structure of the present invention used for a picture frame, etc. consists of an axial member 1S, 1T, 1U or 1V used as a fastener pivotably coupled with a pair of axial member supports 2U used as adjacent frame members, and the frame members are pivotally rotated to hold the exhibited object, etc. D for exhibition.

The axial member supports 2U used as frame members in the present invention are made of a light metal such as aluminum or a hard synthetic resin, etc. Usually two pairs of parallel frame members are arranged to form a rectangle, and are respectively cut at an angle of 45 degrees at both the ends, for joining at right angles, being fixed by axial members is, 1T, 1U or 1V used as fasteners such as joints at the corners. Each of the axial member supports 2U used as frame members has the opening A formed along the length direction, and has the pivotal portion rest 22 at the back side end on one side face of the opening A, which acts as a rest for pivotal rotation when the axial member support is coupled with the axial member 1S, 1T, 1U or 1V used as a joint, etc. at a corner. The axial member support 2U also has the inwardly curved retainer 27 at the front side end on said one side face of the opening A, which acts to retain the transparent sheet such as a glass or acrylic resin sheet on the surface of the exhibited object, etc. D. The side face extending between the front side end and the back side end is formed as a flat long plate as in the conventional picture frames, etc.

The axial member support 2U has the engagement rest 24 projected inwardly on the other side face of the opening A. That is, the curvature 29 almost like a circular arc with a central angle of about 90 degrees, with the pivotal portion rest 22 as the center of rotation is formed from the inside face of the axial member support 2U at an intermediate portion between the curved retainer 27 and the pivotal rotation rest 22, and the engagement rest 24 is projected at the tip of the curvature 29. The curvature 29 is locked at immediately below the engagement rest 24 by the pivotal rotation guide engagement 13*g* formed on the pivotal rotation guide 13 of the fastener described later and by the locking claw 9*b* of the lock member 9 described later.

The axial member 1S, IT, 1U or 1V used as a fastener is integrally formed by a light metal such as aluminum or a hard synthetic resin, etc. like the axial member supports 2U used as frame members. Either of the frame members or the fastener is made of a resilient material for mutual coupling. That is, either of the opening A between the pivotal portion rest 22 and the engagement rest 24 at the tip of the curvature 29, or the axial blade 12 is made resilient by using a resilient material for the respectively corresponding part, to allow coupling. The axial blade 12 has the pivotal portion 11 formed at one edge to be fitted in the pivotal rotation rest 22 for acting as a pivot, and has the disengaging protrusion 15 formed at the other edge, and the pivotal rotation guide 13 like a circular arc with the pivotal portion 11 as the center of rotation is extended from near the disengaging protrusion 15. The disengaging protrusion 15 of the axial blade 12 is pivotally rotated in sliding contact with the inside face of the curvature 29, and if the frame member is pivotally rotated for disengagement, the disengaging protrusion 15 of the axial blade 12 contacts the engagement rest 24 at the tip of the curvature 29, to stop the pivotal rotation, and if the frame member is pivotally rotated to hold the exhibited object, etc. D, the engaging extension 18 extended from the pivotal rotation guide 13 contacts, on its inside face, with the engagement rest 24 at the tip of the curvature 29, for stopping the pivotal rotation.

The pivotal rotation guide 13 has the pivotal rotation guide engagement 13*g* protruded from it toward the inside of the curvature 29, and when the curved retainer 27 keeps the exhibited object, etc. D retained, the pivotal rotation guide engagement 13*g* presses the portion immediately below the projected engagement rest 24. From the pivotal rotation guide 13 of the axial member 1S, 1T, 1U or 1V used as a fastener, the engaging extension 18 is extended to form the back face for containing the curvatures 29 of the axial member supports 2U used as frame members to hold the exhibited object, etc. D, while the fastener depth portions 18*c* are formed downward from the engaging extension 18 perpendicularly to the back face of the picture frame C, etc., with the contact face 18d kept parallel to and support the transparent sheet, the exhibited object and the back sheet, etc. The contact face 18*d* keeps the exhibited object, etc. D to be retained in combination with the curved retainers 27 of the frame members if the frame members are pivotally rotated for engagement.

When the exhibited object, etc. D is held in the picture frame, each of the curvatures 29 is contained in the pivotal rotation guide 13, the engaging protrusion 18 and the fastener depth portion 18*c* of the fastener. In this state, the locking claw 9*b* of the lock member 9 separately pivotably or slidably provided in the fastener protrudes to contact the portion immediately below the engagement rest 24 formed at the tip of the curvature 29 on one side, while the pivotal rotation guide engagement 13*g* formed on the pivotal rotation guide 13 of the fastener contacts the portion immediately below the engagement rest 24 on the other side, for locking the frame member to prevent pivotal rotation.

In the hinge structure with a pair of lock mechanisms of the eleventh embodiment illustrated in FIGS. 37 and 38, the pair of cutout spaces 111 are formed by three-dimensionally cutting out the engaging extension 18 and the fastener depth portions 18*c* of the fastener, to contain the curvatures 29 when the exhibited object, etc. D is held by pivotably rotating the axial member supports 2U used as frame members. Each of the cutout spaces 111 has the opening AA in the back of the engaging extension 18, and also has said pair of mutually facing fastener pivotal portions 112 such as axial protrusions or bearings in parallel to the fastener depth portion 18*c* below the cutout space 111.

On the other hand, each of the lock members 9 consists of the main body 9*a* pivotably provided in each of the cutout spaces 111, the locking claw 9*b* protruding from the main body 9*a* horizontally from the fastener depth portion 18*c* to the cutout space 111, and said pair of lock member pivotal portions 9*c* such as axial protrusions or bearings formed at the base end of the main body 9*a* to be pivotably engaged with the fastener pivotal portions 112 of the axial member 1T. The top of the main body 9*a* is the finger action part 9*d* which can be operated from the opening AA of the cutout space 111 in the back of the engaging extension 18. Said pair of fastener pivotal portions 112 and said pair of lock member pivotal portions 9*c* are only required to structurally allow mutual engagement, and when one pair is axial protrusions, the other pair is bearings.

In the hinge structure with a pair of lock mechanisms of the twelfth embodiment illustrated in FIGS. 39 and 40, the pair of cutout spaces 111 are formed by three-dimensionally cutting out the pivotal rotation guides 13 and the back of the engaging extension 18, among the pivotal rotation guides 13, the engaging extension 18 and the fastener depth portions 18*c* of the fastener, to contain the curvatures 29 when the exhibited object, etc. D is held by pivotally rotating the axial member supports 2U used as frame members. Each of the cutout spaces 111 has the opening AA in the back of the engaging extension 18, and also has said pair of mutually facing fastener pivotal portions 112 such as axial protrusions or bearings in parallel to the pivotal rotation guide 13 below the cutout space 111.

On the other hand, each of the lock members 9 consists of the main body 9*a* pivotably provided in each of the cutout spaces 111, the locking claw 9*b* protruding from the main body 9*a* horizontally from the pivotal rotation guide 13 to the cutout space 111, and said pair of lock member pivotal portions 9*c* such as axial protrusions or bearings formed at the base end of the main body 9*a* to be pivotably engaged with the fastener pivotal portions 112 of the axial member 1U. The top of the main body 9*a* is the finger action part 9*d* which can be operated from the opening AA of the cutout space 111 in the back of the engaging extension 18. Said pair of fastener pivotal portions 112 and said pair of lock member pivotal portions 9*c* are only required to structurally allow mutual engagement, and when one pair is axial protrusions, the other pair is bearings.

In the hinge structure with a pair of lock mechanisms of the thirteenth embodiment illustrated in FIG. 41, the pair of cutout spaces 111 are formed by three-dimensionally cutting out the engaging extension 18 and the backs of the fastener depth portions 18*c*, among the pivotal rotation guides 13, the engaging extension 18 and the fastener depth portions 18*c* of the fastener, to contain the curvatures 29 when the exhibited object, etc. D is held by pivotally rotating the axial member supports 2U used as frame members. Each of the cutout spaces 111 has the opening AA in the back of the engaging extension 18, and also has said pair of mutually facing fastener sliding portions 113 perpendicularly to the fastener depth portion 18*c* below the cutout space 111.

On the other hand, each of the lock members 9 consists of the main body 9*a* pivotably provided in each of the cutout spaces 111, the locking claw 9*b* protruding from the main body 9*a* horizontally from the fastener depth portion 18*c* to the cutout space 111, and said pair of lock member sliding portions 9*e* respectively with a step to allow slidable engagement with said fastener sliding portions 113 formed at the base end of the main body 9*a* to be slidably engaged with the sliding portions 113 of the axial member. The top of the main body 9*a* is the finger action part 9*d* which can be operated from the opening AA of the cutout space 111 in the back of the engaging extension 18. Said pair of fastener sliding portions 113 and said pair of lock member sliding portions 9*e* are only required to structurally allow mutual engagement, and a small protrusion is formed on the sliding face of each sliding portion of either pair, while a small semispherical recess to have the small protrusion inserted is formed in each sliding portion of the other pair, to form a click mechanism.

The hinge structure with a pair lock mechanisms of the present invention consists of the axial member supports 2U used as frame members and the axial member 1S, 1T, 1U or 1V used as a fastener pivotably coupled with each other. In the description of drawings of the above mentioned respective embodiments, the curvature 29 and the pivotal rotation guide 13 are formed like a circular arc respectively, but are not limited to be like a circular arc. They are only required to allow the pivotally rotational engagement, with either of the axial member supports 2U or the axial member 1S, 1T, 1U or 1V made resilient. These embodiments can be achieved if the pivotal portion rest 22 formed in each of the axial member supports 2U and the pivotal portion 11 at the base edge of each of the axial blades 12 to be engaged with the corresponding pivotal rotation rest 22 are the center of the pivotal rotation and if the disengaging protrusion at the other edge of each of the axial blades 12 remains in contact with the corresponding curvature 29 at least at the beginning and end of the pivotal rotation.

Fourteenth to eighteenth embodiments of the present invention are described below in reference to FIGS. 42 to 54. These embodiments are concerned with auxiliary devices to be attached to picture frames C, etc.

FIG. 42 is a perspective view showing a picture frame with an auxiliary device of the fourteenth embodiment. FIG.

44 is a perspective view showing the auxiliary device of the fourteenth embodiment. The auxiliary device can be pivotably attached to a frame member, acting as a standard to support a picture frame C, etc. kept inclined. This embodiment is a hinge structure for a pivotable picture frame C, etc. consisting of an axial member 1W used as an auxiliary device and an axial member support 2V used as a frame member, comprising a pivotal portion 11, being provided at the base edge of an axial blade 12 of the axial member 1W used as an auxiliary device; a disengaging protrusion 15, being provided at the tip edge of the axial blade 12; a pivotal rotation guide 13 with the pivotal portion 11 as the center of rotation, being extended from near the disengaging protrusion 15; an engaging extension 18 as the back face of the auxiliary device, being provided at the tip edge of the pivotal rotation guide 13, with an auxiliary device depth portion **18*e* extended toward the back face of an exhibited object, etc. D, and with an auxiliary device contact face 18*f* provided in parallel to the back face of the auxiliary device and in contact with the back face of the exhibited object, etc. D; an opening A, being formed in the axial member support 2V used as a frame member; a pivotal portion rest 22 to be engaged with the pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the disengaging protrusion 15 or the engaging extension 18 by the pivotal rotation of the axial member 1W, being formed on the other side face opposite to said one side face; a curvature 29, being formed along the circumference of the pivotal rotation guide 13 from the engagement rest 24 to said one side face with the pivotal portion rest 22 formed; and a support rod 18*g* for supporting the picture frame C, etc. kept inclined, being extended from the auxiliary device contact face 18*f*** in a different direction.

FIG. 43 is a perspective view showing a picture frame with the auxiliary devices of the fifteenth and sixteenth embodiments attached. FIG. 45 is a perspective view showing the auxiliary device of the fifteenth embodiment, which retains the back sheet of an exhibited object, etc. D such as a picture frame C, etc. This embodiment is a hinge structure for a pivotable picture frame C, etc. consisting of an axial member 1X used as an auxiliary device and an axial member support 2V used as a frame member, comprising a pivotal portion 11, being provided at the base edge of an axial blade 12 of the axial member 1X used as an auxiliary device; a disengaging protrusion 15, being provided at the tip edge of the axial blade 12; a pivotal rotation guide 13 with the pivotal portion 11 as the center of rotation, being extended from near the disengaging protrusion 15; an engaging extension 18 as the back face of the auxiliary device, being provided at the tip edge of the pivotal rotation guide 13, with an auxiliary device depth portion **18*e* extended toward the back face of an exhibited object, etc. D, and with an auxiliary device contact face 18*f* provided in parallel to the back face of the auxiliary device and in contact with the back face of the exhibited object, etc. D; an opening A, being formed in the axial member support 2V used as a frame member; a pivotal portion rest 22 to be engaged with the pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the disengaging protrusion 15 or the engaging extension 18 by the pivotal rotation of the axial member 1X, being formed on the other side face opposite to said one side face; a curvature 29, being formed along the circumference of the pivotal rotation guide 13 from the engagement rest 24 to said one side with the pivotal portion rest 22 formed; and a retaining rod 18*h* with a certain length for pressing the exhibited object, etc. D from its back, being extended from the auxiliary device contact face 18*f***.

FIG. 46 is a perspective view showing the auxiliary device of the sixteenth embodiment, which reinforces two adjacent frame members of a picture frame C, etc. This embodiment is a hinge structure for a pivotable picture frame C, etc. consisting of two axial members 1Y used as an auxiliary device and two axial member supports 2V used as two adjacent frame members, comprising a pivotal portion 11, being provided at the base edge of an axial blade 12 of each of the axial members 1Y used as an auxiliary device; a disengaging protrusion 15, being provided at the tip edge of the axial blade 12; a pivotal rotation guide 13 with the pivotal portion 11 as the center of rotation, being extended from near the disengaging protrusion 15; an engaging extension 18 as the back face of the auxiliary device, being provided at the tip edge of the pivotal rotation guide 13, with an auxiliary device depth portion **18*e* extended toward the back face of an exhibited object, etc. D and with an auxiliary device contact face 18*f* provided in parallel to the back face of the auxiliary device and in contact with the back face of the exhibited object, etc. D; an opening A, being formed in each of the axial member supports 2V used as frame members; a pivotal portion rest 22 to be engaged with the pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the disengaging protrusion 15 or the engaging extension 18 by the pivotal rotation of the axial member 1Y, being formed on the other side face opposite to said one side face; a curvature 29, being formed along the circumference of the pivotal rotation guide 13 from the engagement rest 24 to said one side with the pivotal portion rest 22 formed; a solid rod 18*i*, being extended from the auxiliary device contact face 18*f* of one of the axial members 1Y toward the other frame member; and an auxiliary device joint 18*k* to be connected with the other solid rod 18*i* or with an extension rod 18*j* connected with the other solid rod 18*i*, being formed in the solid rod 18*i***.

FIG. 48 is a perspective view showing a picture frame using the seventeenth embodiment of the present invention.

FIG. 49 is a perspective view showing an essential portion of the embodiment. FIG. 50 is a sectional view showing an essential portion of the embodiment. FIG. 51 is a perspective view showing the auxiliary device of the embodiment. FIG. 52 is a sectional view showing an essential portion of the auxiliary device. The auxiliary device presented in this embodiment is used to support a picture frame C, etc. kept inclined, using a rod member E. This embodiment is a hinge structure for a pivotable picture frame C, etc., consisting of an axial member 1Z or **1Z*a* used as an auxiliary device and an axial member support 2V used as a frame member, comprising a pivotal portion 11, being provided at the base edge of an axial blade 12 of the axial member 1Z or 1Z*a* used as an auxiliary device; a disengaging protrusion 15, being provided at the tip edge of the axial blade 12; a pivotal rotation guide 13 with the pivotal portion 11 as the center of rotation, being extended from near the disengaging protrusion 15; an opening A, being formed in the axial member support 2V used as a frame member; a pivotal portion rest 22 to be engaged with the pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the disengaging protrusion 15 or an engaging extension 18 by the pivotal rotation of the axial member 1Z or 1Z*a*, being formed on the other side face opposite to said one side face; a curvature 29, being formed along the circumference of the pivotal rotation guide 13 from the engagement rest 24 to said one side with the pivotal portion rest 22 formed; and said engaging extension 18, being formed at the tip edge of the pivotal rotation guide 13 of the axial member 1Z or 1Z*a* used as an auxiliary device, and being provided with an arrester 18*m* or 18*n*** to be engaged with the form of a rod member E.

FIG. 53 is a partially cutaway perspective view showing an eighteenth embodiment, and FIG. 54 is a sectional view showing the embodiment. The auxiliary device of this embodiment is used to hang a picture frame C, etc. on a wall or pillar, etc. This embodiment is a hinge structure for a pivotable picture frame C, etc., consisting of an axial member 1AB used as an auxiliary device and an axial member support 2V used as a frame member, comprising a pivotal portion 11, being provided at the base edge of an axial blade 12 of the axial member 1AB used as an auxiliary device; a disengaging protrusion 15, being provided at the tip edge of the axial blade 12; an opening A, being formed in the axial member support 2V used as a frame member; a pivotal portion rest 22 to be engaged with the pivotal portion 11, being formed at one end on one side face of the opening A; a curved retainer 27 for keeping the surface of the exhibited object, etc. D pressed and fixed, being formed at the other end on said one side face of the opening A; a projected engagement rest 24 to be engaged with the disengaging protrusion 15 or an engaging extension 18 by the pivotal rotation of the axial member 1AB, being formed on the other side face opposite to said one side face; a curvature 29 with the pivotal portion rest 22 as the center of rotation, being formed from the engagement rest 24 to said one side with the pivotal portion rest 22 formed; and said engaging extension 18 of the axial member 1AB used as an auxiliary device, being provided with a hanging piece **18*r* with a hanging portion 18*q*** formed in it.

The axial member support 2V used as a frame member in the fourteenth to eighteenth embodiments shown in FIGS. 42 to 54 is made of a light metal such as aluminum or a hard synthetic resin, etc. Usually two pairs of parallel frame members are arranged to form a rectangle, and the respective frame members are cut at an angle of 45 degrees at both the ends, to be coupled at right angles with each other, and fixed using corner fasteners. The axial member support 2V used as each of the frame members is curved inward at the end on the front side extending in the length direction, to form the curved retainer 27 which retains the transparent sheet such as a glass or acrylic resin sheet on the surface of the exhibited object, etc. D from the front, and has, at the end on the back side, the pivotal portion rest 22 to be engaged with the pivotal portion 11 formed at one edge of the axial blade 12 of the axial member 1W, 1X, 1Y, 1Z, **1Z*a* or 1AB used as an auxiliary device described later. At the other edge of the axial blade 12, the disengaging protrusion 15 is provided. The outside extending between the end of the front side and the end of the back side of the axial member support 2V** is flat as in the conventional frame members.

That is, the axial member support 2V used as a frame member has the opening A formed, and the pivotal portion rest 22 to be engaged with the pivotal portion 11 is formed at one end on one side face of the opening A, while the curved retainer 27 to keep the surface of the exhibited object, etc. D held and fixed is formed at the other end on said one side face. On the other side face opposite to said one side face of the opening A, the engagement rest 24 to be engaged with the disengaging protrusion or the engaging extension 18 by the pivotal rotation of the axial member 1W, 1X, 1Y, 1Z, **1Z*a* or 1AB is projected, and the curvature 29 is formed along the circumference of the pivotal rotation guide 13 from the engagement rest 24 to said one side with the pivotal portion 22** formed.

The axial member 1W, 1X, 1Y, 1Z, **1Z*a* or 1AB as the auxiliary device is made of a light metal such as aluminum or a hard synthetic resin, etc. Either of the frame member or the auxiliary device is made of a resilient material to allow both the members to be coupled. The pivotal portion 11 at one edge of the axial blade 12 is engaged with the pivotal portion rest 22 of the axial member support 2V, and the disengaging protrusion 15 at the other edge of the axial blade 12 is in slidable contact with the inside of the curvature 29 of the axial member support 2V, for pivotal rotation. Either of the disengaging protrusion 15 of the axial blade 12 of the axial member 1W, 1X, 1Y, 1Z, 1Z*a* or 1AB and the curvature 29 of the axial member support 2V, or the pivotal rotation guide 13 of the axial member 1W, 1X, 1Y, 1Z, 1Z*a* or 1AB and the projected engagement rest 24 of the axial member support 2V** are made resilient.

The pivotal rotation guide 13 with the pivotal portion 11 as the center of rotation, extended from near the disengaging protrusion 15 of the axial blade 12 is a circular arc in cross section, to almost agree with the inside form of the curvature 29 of the axial member support 2V, and the circular arc has a central angle of almost 90 degrees with the pivotal portion 11 at one edge of the axial blade 12 as the center of rotation.

Furthermore, the pivotal rotation guide 13 has a groove formed at the other edge to have the engagement rest 24 of the axial member support 2V inserted to achieve engagement after completion of pivotal rotation, and has the engaging extension 18 extended. The engaging extension 18 has the auxiliary device depth portion **18*e* formed downward toward the back sheet overlapped on the back face of the exhibited object. etc. D, to contain the curvature 29 of the axial member support 2V after completion of pivotal rotation, and has the auxiliary device contact face 18*f* parallel to the back face of the auxiliary device and in contact with the back face of the exhibited object, etc. D. The auxiliary device contact face 18*f* and the curved retainer 27 of the axial member support 2V** retain the transparent sheet and the back sheet overlapped on both sides of the exhibited object, etc. D.

The auxiliary device contact face **18*f* has the support rod 18*g*** extended in a different direction. The different direction refers to the direction in which the distance between the auxiliary device attached to the frame member and the surface of the picture frame C, etc. kept inclined is the shortest, that is, the direction in which the picture frame C, etc. kept inclined can be supported its position.

In the embodiment shown in FIG. 44, the axial member 1W as the auxiliary device has a cutout 115 formed to have a corner by partially cutting out the axial blade 12 and the pivotal rotation guide 13, and a fastening plate 10 is kept in contact with the cutout 115, for arresting the pivotal rotation of the auxiliary device in vertical direction, and has a pair of legs **10*a* protruded to be slidably fitted between the pivotal portion rest 22 of the axial member support 2V used as a frame member and the engagement rest 24 of the curvature 29. The legs 10***a* may have rail-like grooves formed at the tops. The fastening plate 10 is slidably in contact between the pivotal portion rest 22 of the axial member support 2V used as a frame member and the engagement rest 24 of the curvature 29, and the support 18*g* of the auxiliary device supports the back sheet of the picture frame C, etc. and stops the sliding. As an alternative, a small protrusion for temporarily stopping pivotal rotation may be formed on the curvature 29 of the frame member.

The auxiliary device with the retaining rod 18*h* for the exhibited object, etc. D illustrated in FIGS. 43 and 45 is used to press and fix the exhibited object etc. D held between the transparent sheet and the back sheet of the picture frame C, etc., from the back. FIG. 47 illustrates how any of the auxiliary devices used in the fourteenth to eighteenth embodiments and a frame member are connected or used. The sectional structures of essential portions are almost the same, and the description of the respective structures is not made here.

The auxiliary device contact face 18*f* of the axial member 1X used as an auxiliary device has the retaining rod 18*h* extended instead of the support rod 18*g*. As shown in FIG. 45, the retaining rod 18*h* should be desirably formed to be somewhat longer in the orthogonal direction and to be like a bow at the center, for being resilient.

In the embodiment shown in FIGS. 43 and 46, the solid rod 18*i* is extended from the auxiliary device contact face 18*f* toward the other frame member, and the auxiliary device joint 18*k* to be connected with the solid rod 18*i* formed in the other axial member 1Y used in the other auxiliary device or with the extension rod 18*j* connected with the other solid rod 18*i* is formed in the solid rod 18*i*. That is, two axial members 1Y and 1Y used as an auxiliary device are connected with the axial member supports 2V and 2V used as adjacent frame members, and the respective auxiliary device joints 18*k* and 18*k* of the respective solid rods 18*i* and 18*i* can be connected directly to each other or indirectly through the extension rod 18*j* at the extension rod joint 181 formed in the extension rod 18*j*.

In the embodiment shown in FIGS. 48 and 50, the engaging extension 18 of the axial member 1Z has the arrester 18*m* extended to be able to be engaged with the form of the rod member E used as a standard. As shown in FIGS. 49 and 50, the arrester 18*m* can be installed in each of the axial member supports 2V and 2V used as the vertical frame members on both sides of the picture frame C, to arrest the rod member E around its circumference. Furthermore, as shown in FIGS. 51 and 52, the arrester 18*n* is installed in the axial member support 2V used as the top horizontal frame member, to arrest the rod member E at its axial end.

The arrester 18*m* to arrest the rod member E used as a standard around its circumference is like a circular arc suitable for the body of the rod member E when the body of the rod member E is like a pipe circular in cross section as shown in FIGS. 49 and 50. If the auxiliary device is made of a flexible material like a resilient plastic material, it arrests by its resiliency. If the rod member E is rectangular in cross section, the arrester 18*m* is formed to suit the rectangle.

The rod member E used as a standard has a slide-down preventive means 116 such as a point protrusion or an annular protrusion to prevent the picture frame C, etc. from sliding down by its weight, or a recess and a protrusion as slide-down preventive means 116 are formed respectively at the engagement rest 24 at the tip edge of the curvature 29 of the axial member support 2V and at the other edge of the disengaging protrusion 15 at the tip edge of the axial blade 12 of the axial member 1Z.

The axial member 1Z*a* as an auxiliary device illustrated in FIGS. 51 and 52 has the arrester 18*n* formed to be engaged with the top end of the rod member E used as a standard.

The arrester 18*n* is formed like a short cylinder below a reinforced board 18*p* extended from the engaging extension 18 of the axial member 1Z*a*, in order that it may be fitted at the top end of the rod member E formed like a pipe. In the illustrated embodiment, it is inserted in the rod member E but can also be formed as a short cylinder opened at the bottom, to cover the top end of the rod member E. As shown in FIG. 48, this embodiment uses three standards. That is, the two axial member supports 2V and 2V used as the vertical frame members on both sides the picture frame C are mounted respectively with two axial members 1Z and 1Z used as auxiliary devices, to be engaged with two rod members E by the arresters 18*m* and 18*m*, and in addition, the top frame member has the arrester 18*n* to be engaged with the top end of a third rod member E.

The axial member 1AB used as an auxiliary device illustrated in FIGS. 53 and 54 has the hanging piece 18*r* with the hanging portion 18*q* instead of the arrester 18*n* of the axial member 1Z*a*. The axial member support 2V used as a frame member, the axial blade 12 and the engaging extension 18 are structurally the same as those described before and are not described here.

The hanging piece 18*r* extended from the engaging extension 18 has a round hole or square hole, etc. formed, or a hook protruded as the hanging portion 18*q*. It is only required that the hanging piece 18*r* can be suspended using a string or wire, etc.

The axial member support 2V as a frame member can be mounted with the axial member 1W, 1X, 1Y, 1Z, 1Z*a* or 1AB used as an auxiliary device, by inserting and pivotally rotating the pivotal portion 11 at one edge of the axial blade 12 of the axial member 1W, 1X, 1Y, 1Z, 1Z*a* or 1AB in the pivotal portion rest 22 of the opening A of the axial member support 2V, for coupling by the resiliency of any of the parts concerned. Further pivotal rotation lets the engagement rest 24 at the tip edge of the curvature 29 contact the engaging extension 18 or be inserted into the groove formed in the pivotal rotation guide 13, for stopping pivotal rotation. If the axial member 1W, 1X, 1Y, 1Z, 1Z*a* or 1AB is pressed from inside toward the axial member support 2V used as a frame member for pivotal rotation in the opposite direction, the engagement rest 24 of the axial member support 2V is disengaged from the groove of the pivotal rotation guide 13, causing the engagement rest 24 at the tip edge of the curvature 29 to contact the disengaging protrusion 15, for stopping pivotal rotation. Further pivotal rotation allows the auxiliary device to be decoupled from the frame member by resiliency.

FIG. 55 is a sectional view showing an essential portion of a nineteenth embodiment. FIG. 56 is a sectional view showing an essential portion of a twentieth embodiment, and FIG. 57 is a partially cutaway perspective view of the embodiment. These embodiments relate to an auxiliary device attached to the frame members of two picture frames C and C, etc., for exhibiting the two picture frames C and C, etc. kept close to each other back to back, or at right angles, or side by side.

The nineteenth embodiment is, as shown in FIG. 55, a hinge structure for allowing pivotable picture frames C and C, etc. to be presented for exhibition as a pair, consisting of an axial member 1BB used as an auxiliary device and two axial member supports 2W and 2W used as frame members, comprising an opening A, being formed in each of the axial member supports 2W and 2W used as frame members; a pivotal portion rest 22 to be engaged with the corresponding one of a pair of pivotal portions 11 of the axial member 1BB, being formed at one end on one side of the opening A; a curved retainer 27 for keeping the surface of an exhibited object, etc. D pressed and fixed, being formed at the other end on said one side face of the opening A; a projected engagement rest 24 to be engaged with a disengaging protrusion 15 or the corresponding one of a pair of disengaging protrusions 15 or the corresponding one of a pair of engaging extensions 18 by the pivotal rotation of the axial member 1BB, being formed on the other side face opposite to said one side face; a curvature 29 with the pivotal portion rest 22 as the center of rotation, being formed from the engagement rest 24 to said one side with the pivotal portion rest 22 formed; a pivotal rotation guide 13 for connecting the two axial member supports 2W and 2W used as frame members to have two picture frames C and C, etc. kept close to each other back to back or at right angles, being formed in the axial member 1BB used as an auxiliary device and having axial blades 12 and 12 extended on both sides; two pivotal portions 11 to be engaged with the pivotal portion rests 22, being formed at the base edges of the respective axial blades 12 and 12; said disengaging protrusion 15, being formed at the tip edge of at least one of the axial blades 12; and said engaging extensions 18 to be engaged with the engagement rests 24 and 24 of the two respective axial member supports 2W and 2W used as frame members kept closely to each other, being formed at the center of the pivotal rotation guide 13.

The twentieth embodiment is, as shown in FIGS. 56 and 57, a hinge structure for allowing pivotable picture frames C and C, etc. to be presented for exhibition as a pair, consisting of an axial member 1CC used as an auxiliary device and two axial member supports 2W and 2W used as frame members, comprising an opening A, being formed in each of the axial member supports 2W and 2W used as frame members; a pivotal portion rest 22 to be engaged with the corresponding one of a pair of pivotal portions 11 of the axial member 1CC, being formed at one end on one side of the opening A; a curved retainer 27 to keep the surface of an exhibited object, etc. D pressed and fixed, being formed at the other end on said one side of the opening A; a connection board 102 for connecting the mutually closely located member frames to keep the two picture frames C and C, etc. side by side, being formed in the axial member 1CC used as an auxiliary device; an insertion hole 105 to be filled with an insert 104 with a wedge portion 103, being formed in the connection board 102; a pair of engagement claws 106 and 106 to be engaged with the pivotal portion rests 22 and 22 of the axial member supports 2W and 2W, being provided on both sides of the insertion hole 105, to face each other; wherein said pair of engagement claws 106 and 106 are engaged with the pivotal portion rests 22 and 22 of the axial member supports 2W and 2W, and the wedge portion 103 of the insert 104 is inserted to be fixed in the insertion hole 105, for holding the two frame members by the wedge portion 103 of the insert 104 and the engagement claws 106 and 106 of the connection board 102. In the nineteenth and twentieth embodiments, two axial member supports 2W used as frame members identical in cross sectional form can be used to connect two picture frames C, etc. closely to each other back to back, or at right angles, or side by side, for easily allowing them to be presented for exhibition as a pair. In the nineteenth embodiment, the pivotal portion 11 at one edge of each of the two axial blades 12 of the axial member 1BB used as an auxiliary device is engaged with the pivotal portion rest 22 of one of the two axial member supports 2W and 2W used as frame members. Pivotal rotation causes the corresponding engaging extension 18 to contact the corresponding engagement rest 24, for stopping the pivotal rotation. Thus, two picture frames C and C, etc. can be connected back to back or at right angles, by connecting the frame members close to each other using the axial member 1BB.

In the twentieth embodiment, the opening A is formed in each of the two axial member supports 2W used as frame members, and the pivotal portion rest 22 is formed on one side face of the opening A. The axial member 1CC used as an auxiliary device has the connection board 102, the insertion hole 105 and the pair of the engagement claws 106 and 106 formed. The insert 104 with the wedge portion 103 is inserted and fixed in the insertion hole 105, so that the pivotal portion rests 22 and 22 of the axial member supports 2W and 2W may be held near inside and outside by the both the sides of the wedge portion 103 of the insert 104 and by the respective engagement claws 106 and 106, for connecting the adjacent frame members closely to each other, for allowing a pair of picture frames to be presented for exhibition.

Effects of the Invention

The present invention consisting of an axial member and an axial member support(s) composed as described in the above embodiments have the following effects.

In each coupling consisting of the axial member and the axial member support, the pivotably coupled axial member is made partially resilient, and the pivotal portion is provided at the tip of the resilient portion. The axial member can be slidably pressed into the axial member support from the opening formed perpendicularly to the axial direction, with the resilient portion of the axial member bent, for simply achieving the pivotable coupling. Furthermore, in the present invention, it can be easily made possible to optionally control the sliding frictional resistance during pivotal rotation after completion of coupling.

The hinge structures of the present invention can be widely used for structures, mechanisms, etc. of rotation portions in furniture, vessels, office machines, cars, airplanes, communication apparatuses, measuring instruments, ships, containers, etc. as pivotably and detachably coupled structures substituting the conventional hinge structures. In addition, they do not require any pin, are detachable, and can achieve pivotable coupling kept invisible in appearance.

Moreover, decoupling after completion of pivotable coupling can be effected in many ways, and so the method suitable for each coupling condition can be optionally selected.

Compared to the conventional detachable hinge which requires the shaft of either hinge member to move laterally for coupling and decoupling, the present invention allows simpler coupling and decoupling from the front of an opening in a member.

The conventional hinge which allows coupling and decoupling in the direction perpendicular to the shaft is not determined in pivotal rotation orbit and can cause the pivotal rotation to be astray, resulting in decoupling during pivotal rotation. So, the conventional of this type is limited in application.

Furthermore, the pivotal rotation guide can be provided as a slope with engagements, to allow a pause during pivotal rotation or to achieve engagement or disengagement at the pivotal rotation halt position. Moreover, the pivotal sliding contact portions can be made to generate strip torque and lock torque to allow the control of pivotal rotation process, for use as a pivotable damper using the frictional resistance during pivotal rotation.

In addition, if the sliding contact portions such as the pivotal rotation guide and the disengaging protrusion of the axial member and the curvature of the axial member support are made of any small wear resistant material such as teflon, etc., the axial member and the axial member support can be very durable, to provide an epochal hinge structure.

The hinge structure of the present invention consisting of an axial member used as a fastener and axial member supports used as frame members, and with a pair of lock mechanisms has a pair of cutout spaces formed with three-dimensional openings in the pivotal rotation guides, engaging extension, fastener depth portions, etc. of the axial member containing the curvatures of the axial member supports when the exhibited object, etc. is held by the frame members and the fastener, and each of a pair of lock members is installed in each of the cutout spaces, to allow the locking claw of the lock member to be protruded by pivotal rotation or sliding for contacting the portion immediately below the engagement rest projected at the edge of each of the curvatures, thereby achieving locking. The locking and unlocking can be effected without any action error and without using any tool. Good looking and practicality make the hinge structure more significant. In the hinge structure of the present invention consisting of an axial member used as an auxiliary device and an axial member support as a frame member, the auxiliary device simply mounted by pivotal rotation on the frame member can be used as a support for keeping a picture frame, etc. inclined, as a retainer for the back sheet of a picture frame, etc., as a reinforcement for frame members of a picture frame, etc., as an auxiliary device to be engaged with a rod member used as a standard for supporting a picture frame, etc., or also as an auxiliary device for hanging a picture frame, etc. Even when it is desired to use the picture frame, etc. in a different way after purchase of it, it can be used in the desired way simply by exchanging the auxiliary device for the desired auxiliary device. Furthermore, if the frame members are identical in sectional form, the auxiliary devices of the present invention can be commonly used for variously sized picture frames, etc. So, highly practical auxiliary devices can also be presented significantly in the present invention.

The auxiliary device of the present invention which can be presented for exhibition picture frames, etc. as a pair can exhibit the adjacent two picture frames, etc. back to back, or at right angles, or side by side. If many such auxiliary devices for exhibition as pairs are used in combination, many picture frames, etc. can be presented over the entire surface of a large wall, or picture frames, etc. can be placed back to back, or using corners of a room for extensive exhibition. This version of the present invention is also highly practical.

Figure 1:
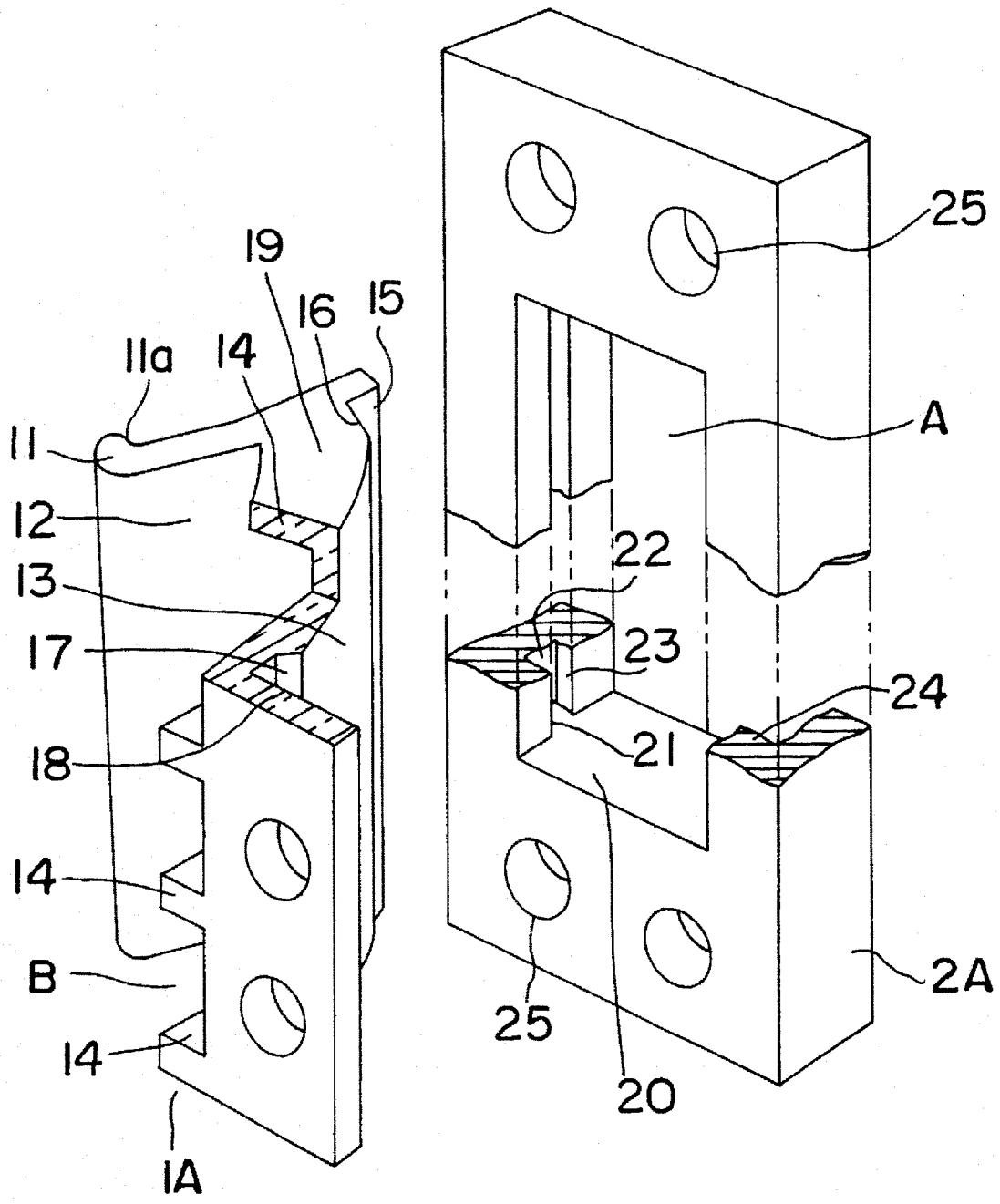
FIG. 1 is a partially cutaway perspective view showing the first embodiment.
Figure 2:
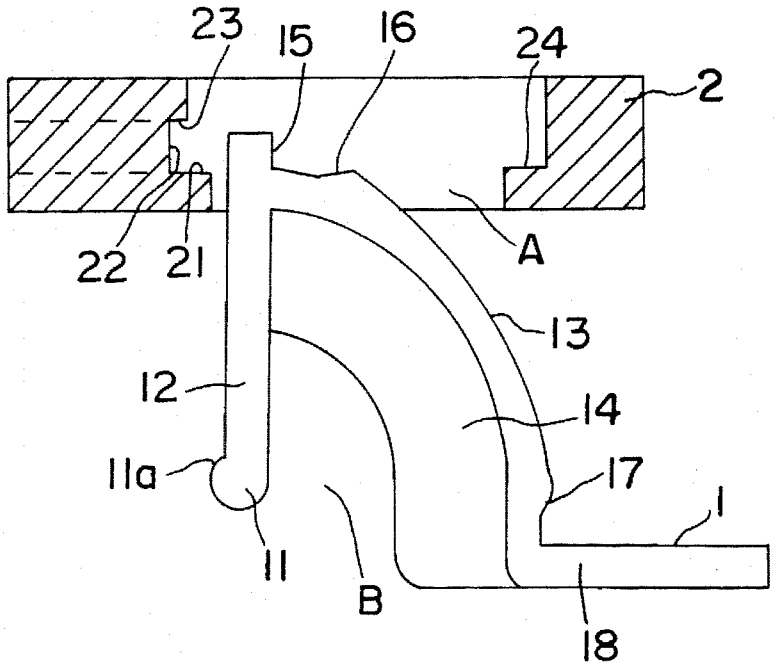
FIG. 2 is a sectional view showing an essential portion of the first embodiment.
Figure 3:
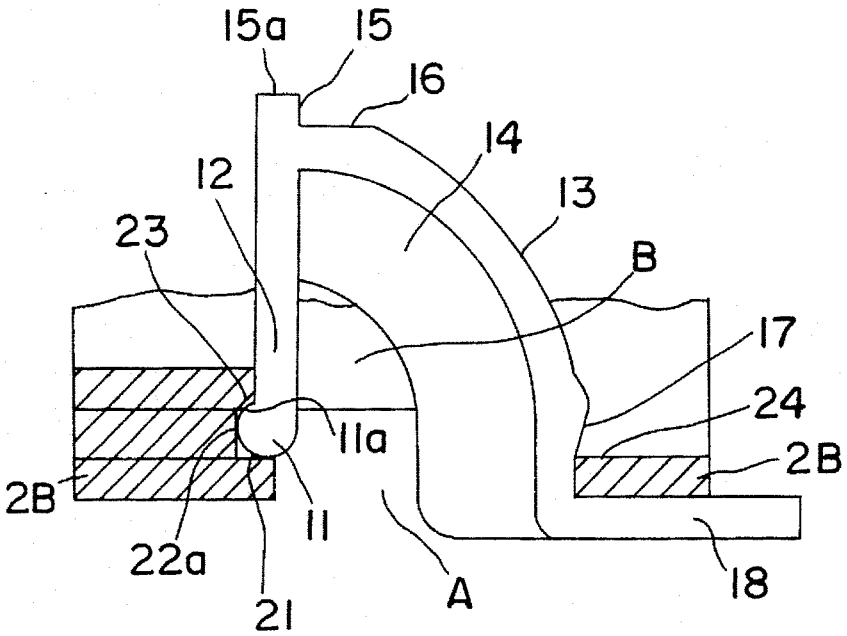
FIG. 3 is a sectional view showing an essential portion of another example corresponding to FIG. 2.
Figure 4:
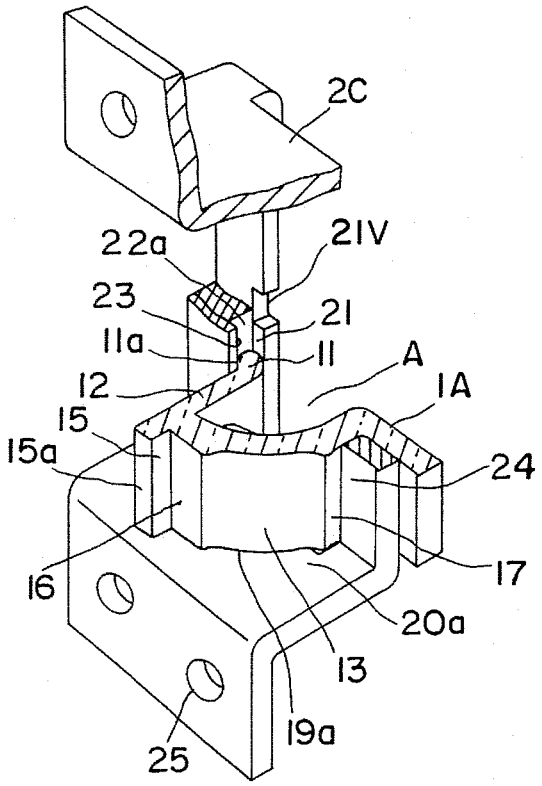
FIG. 4 is a partially cutaway perspective view showing another example of the first embodiment.
Figure 5:
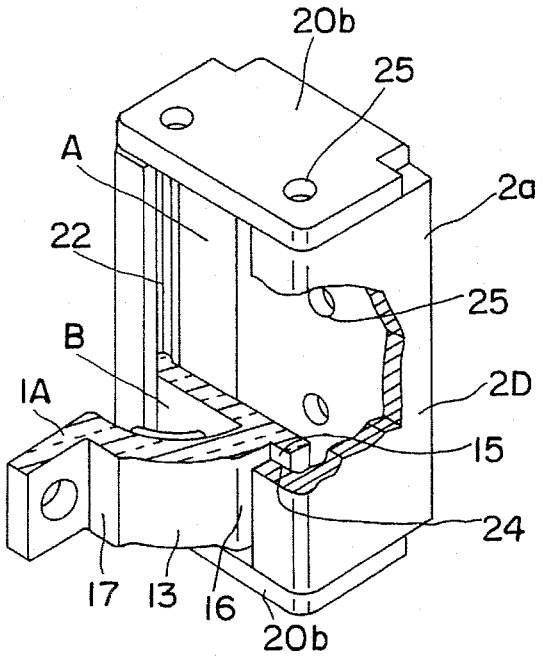
FIG. 5 is a partially cutaway perspective view showing a further other example of the first embodiment.
Figure 6:
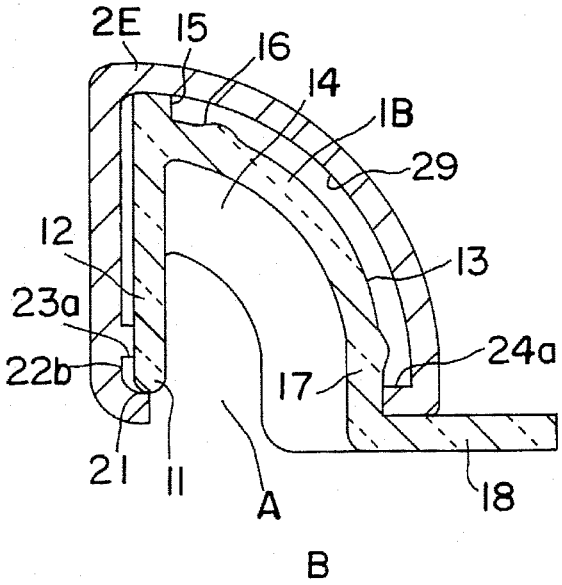
FIG. 6 is a sectional view showing an essential portion of the second embodiment.
Figure 7:
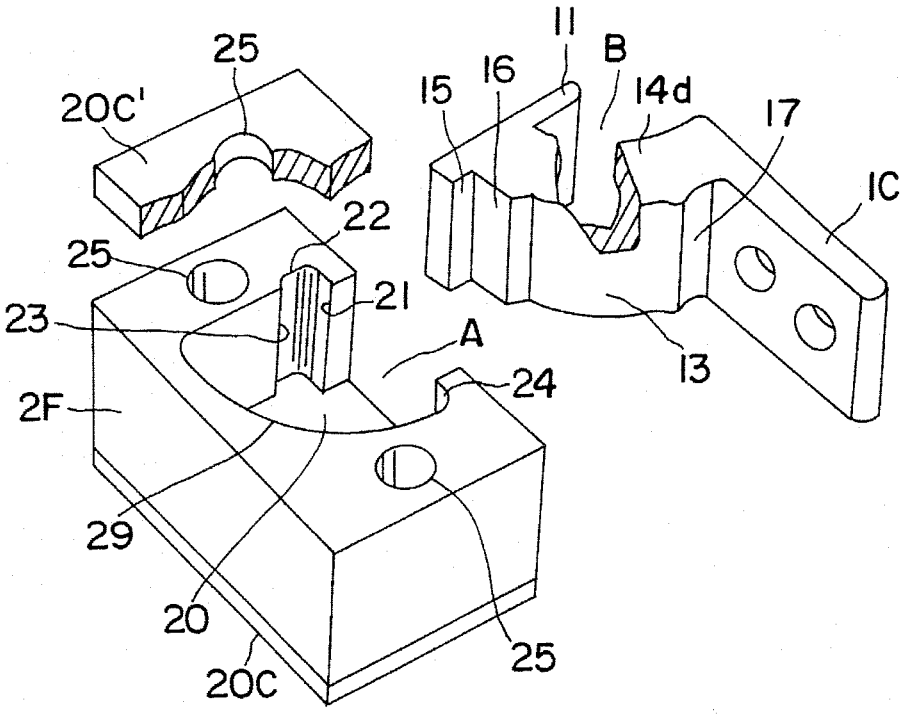
FIG. 7 is a partially cutaway perspective view showing another example of the second embodiment.
Figure 8:
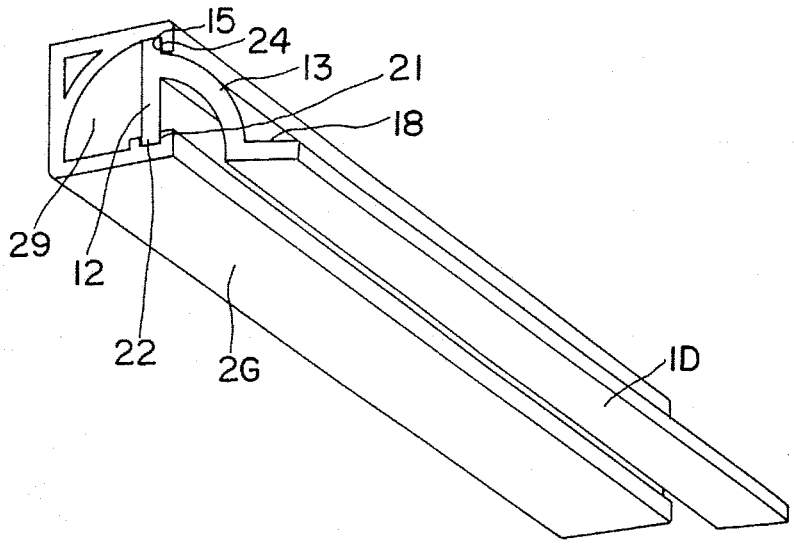
FIG. 8 is a perspective view showing the second embodiment of FIG. 6.
Figure 9:
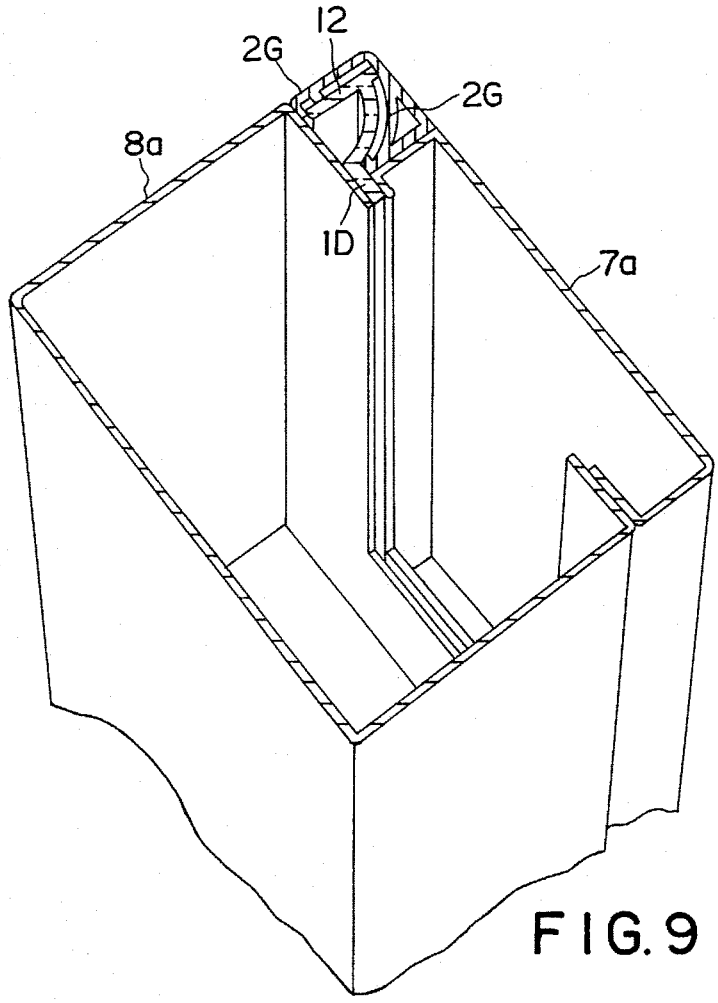
FIGS. 9 and 10 are perspective views showing how the second embodiment is used.
Figure 10:
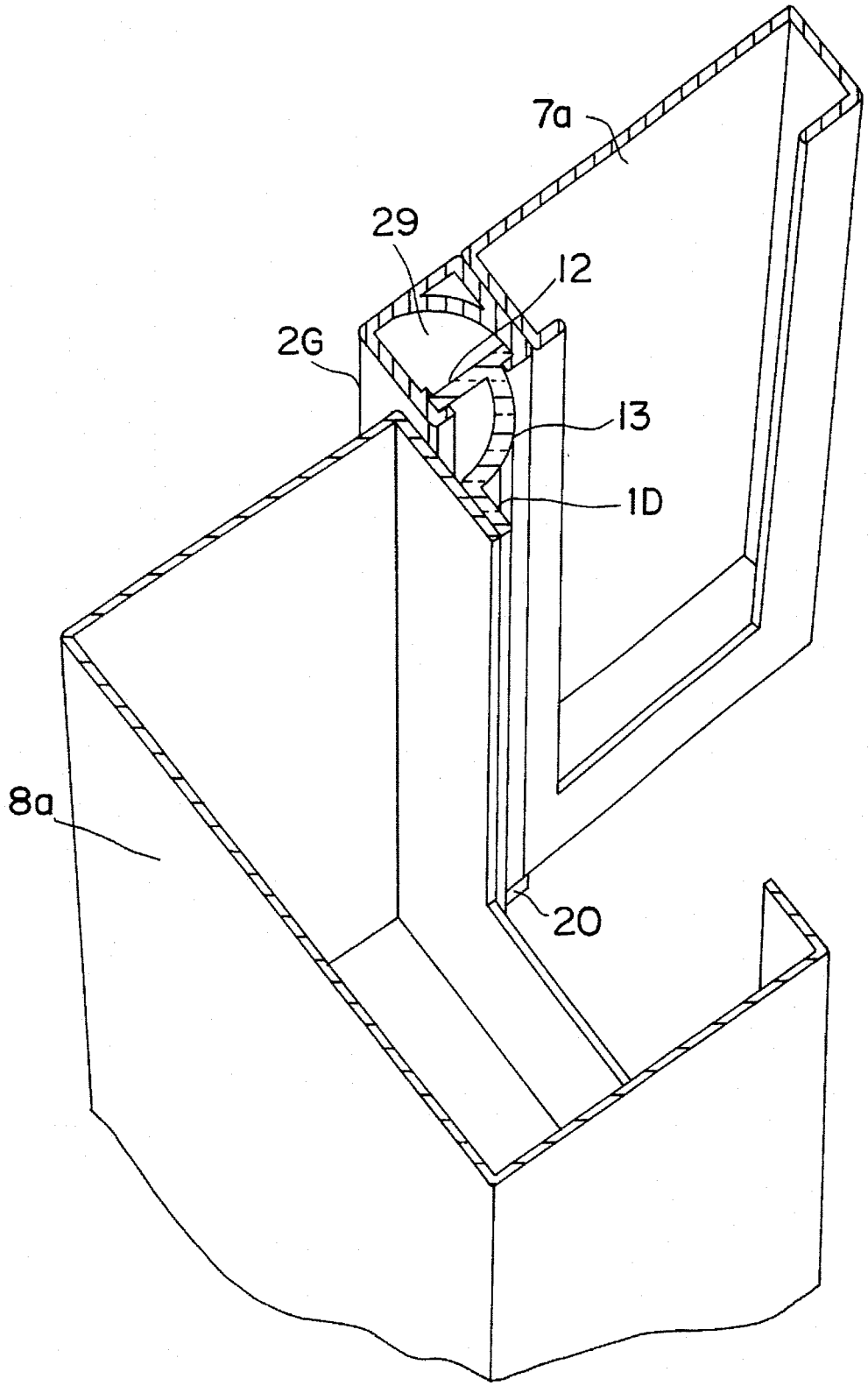
Figure 11:
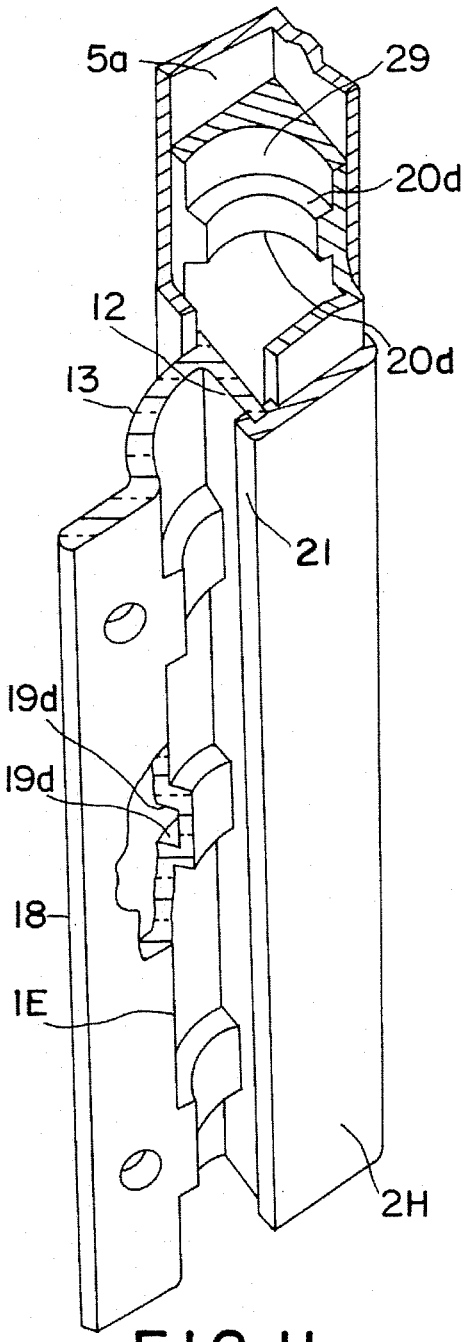
FIG. 11 is a partially cutaway perspective view showing the third embodiment.
Figure 12:
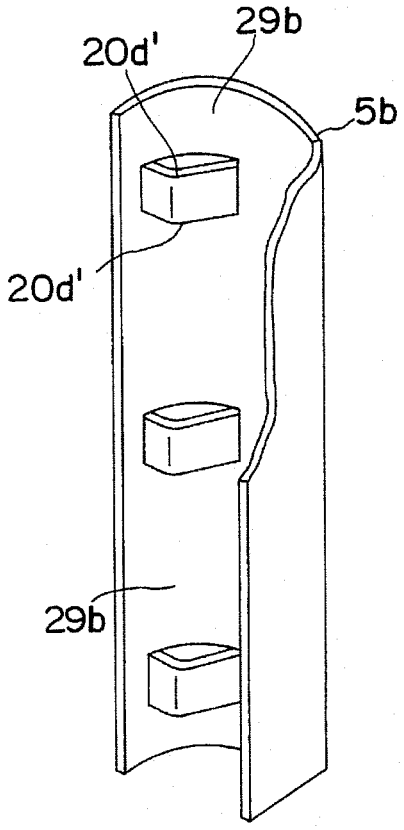
FIG. 12 is a perspective view showing another example of the spacers shown in FIG. 11.
Figure 13:
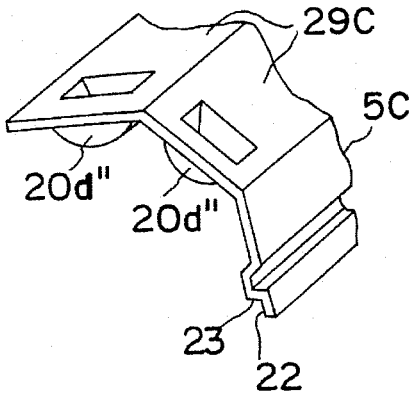
FIG. 13 is a perspective view showing a further other example of the spacers.
Figure 14:
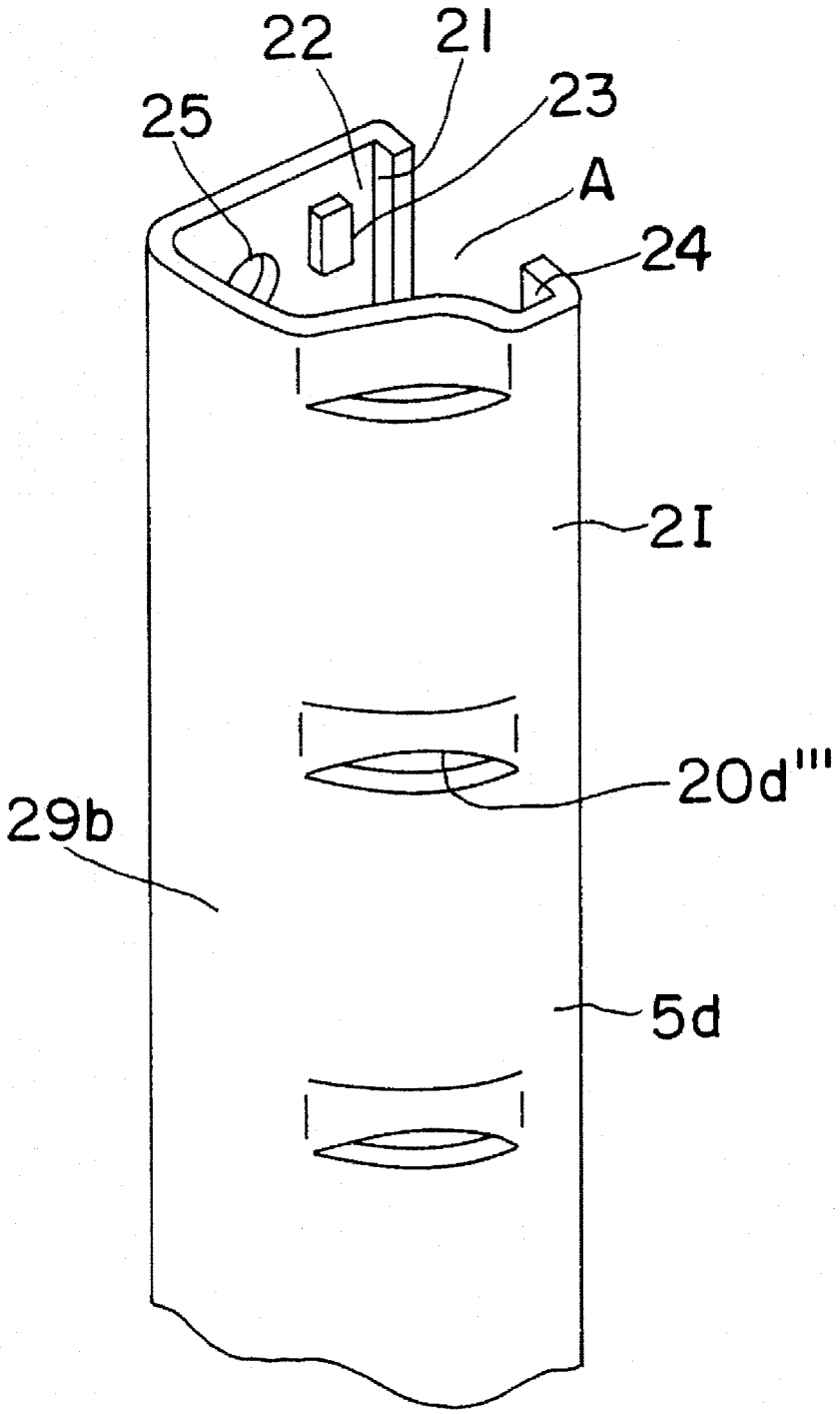
FIG. 14 is a perspective view showing a still further other example of the spacers.
Figure 15:
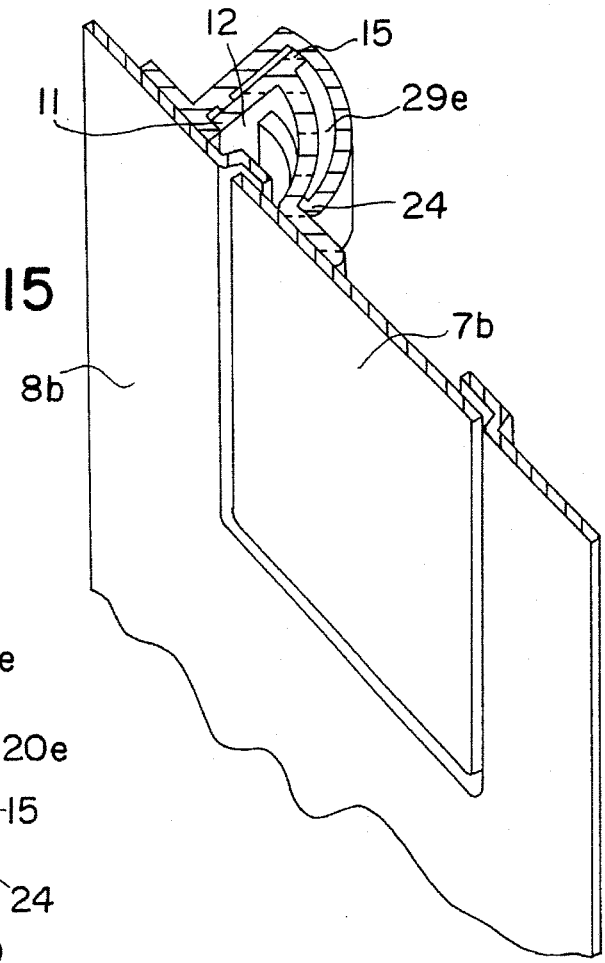
FIGS. 15 and 16 are perspective views showing how a still further other example is used.
Figure 16:
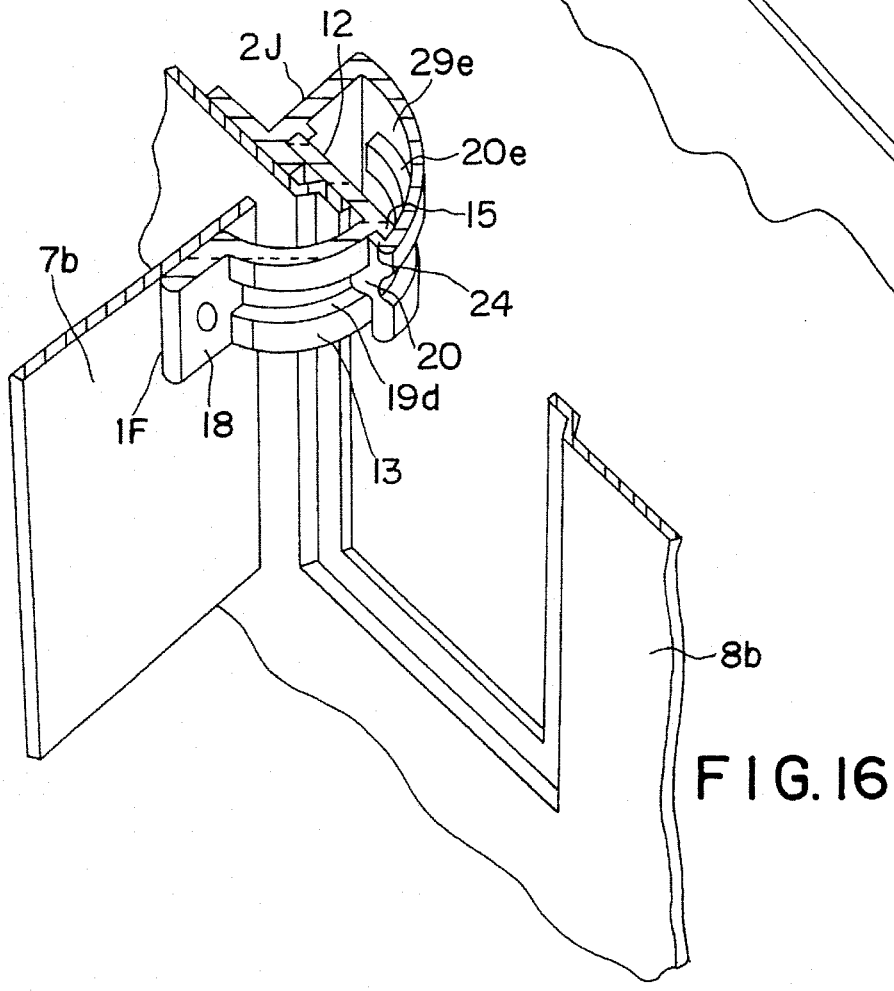
Figure 17:
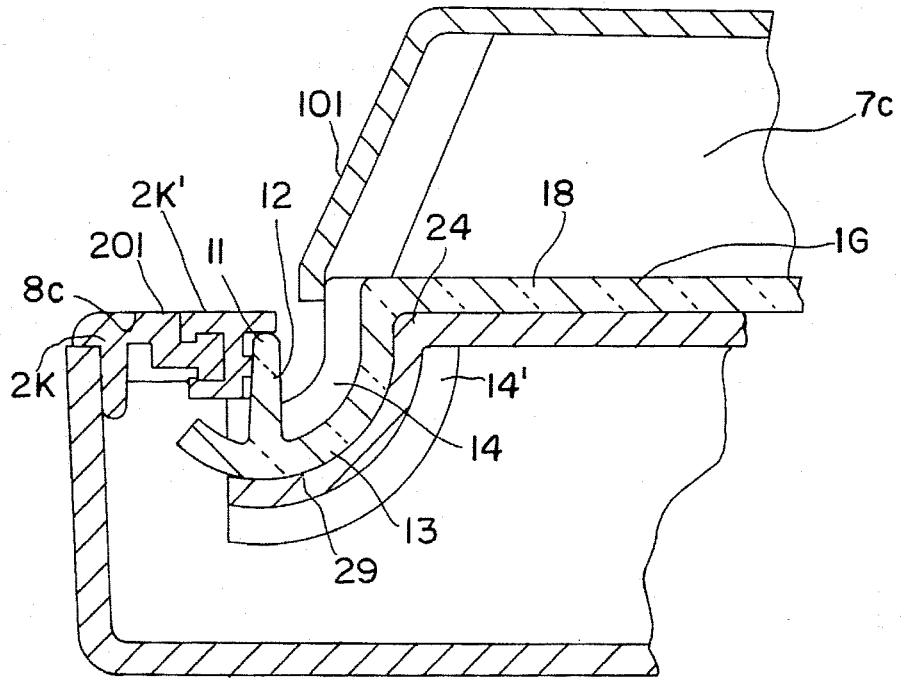
FIG. 17 is a sectional view showing an essential portion of the fourth embodiment.
Figure 18:
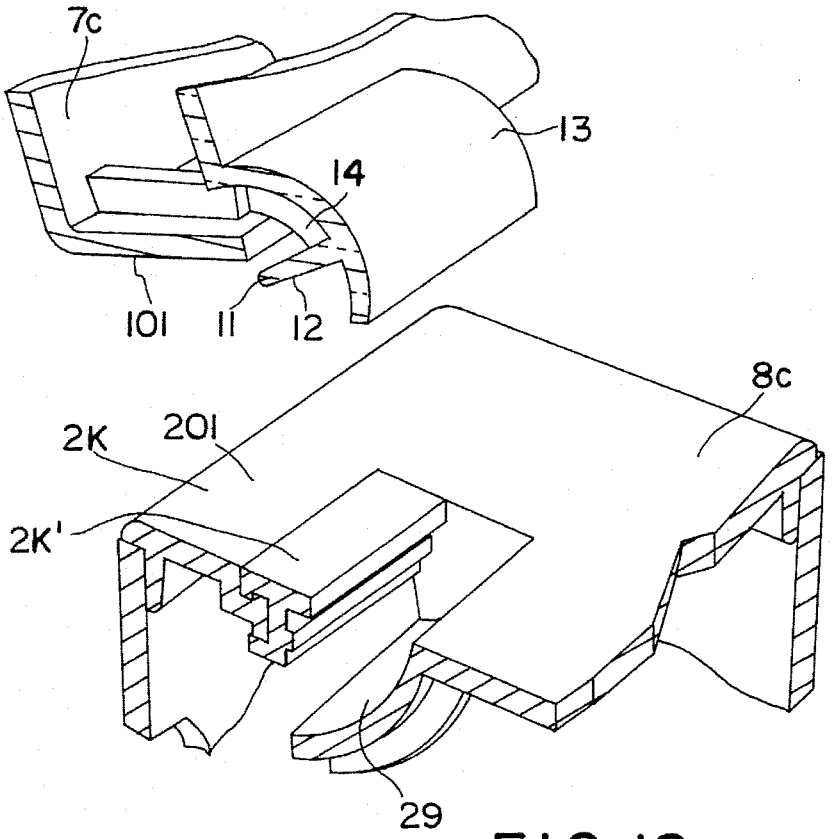
FIG. 18 is a partially cutaway perspective view showing the fourth embodiment.
Figure 19:
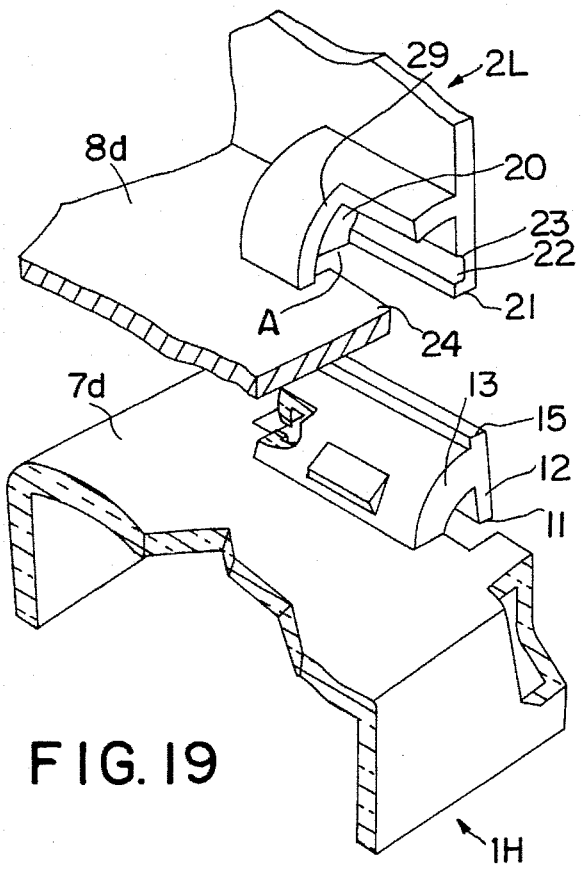
FIG. 19 is a partially cutaway perspective view showing another example of the fourth embodiment.
Figure 20:
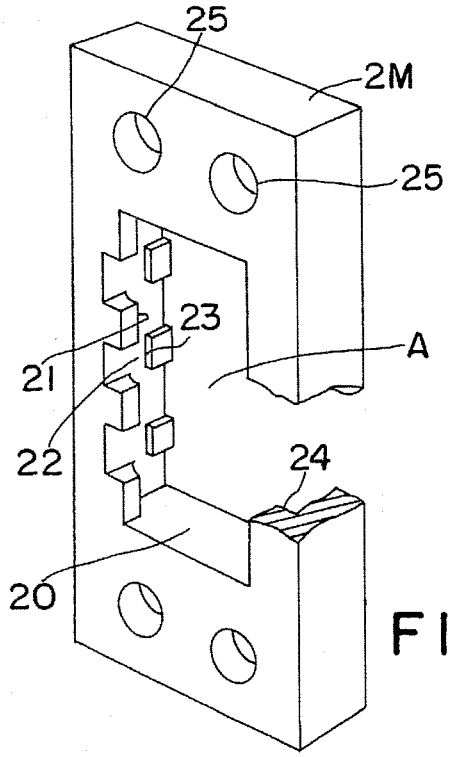
FIG. 20 is a partially cutaway showing a still further other example of the present invention.
Figure 21:
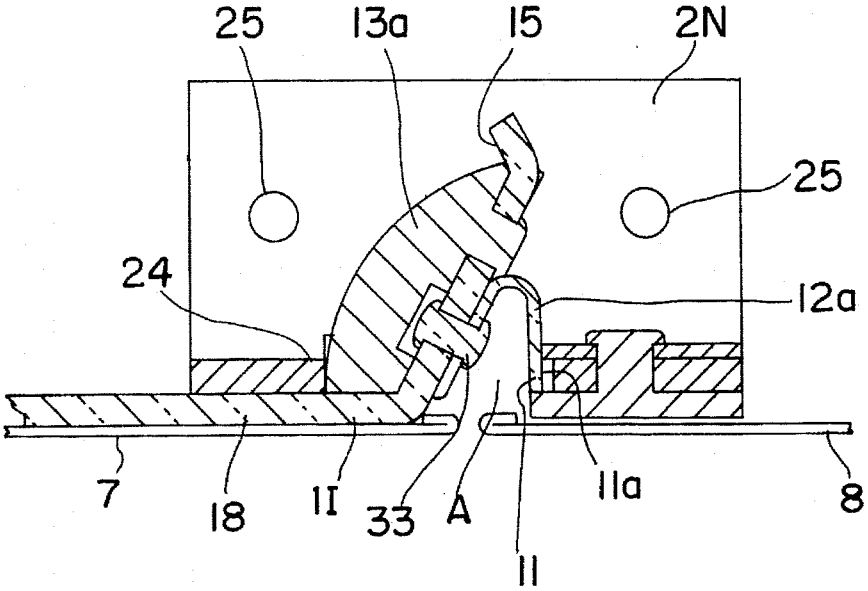
FIG. 21 is a sectional view showing an essential portion of the fifth embodiment.
Figure 22:
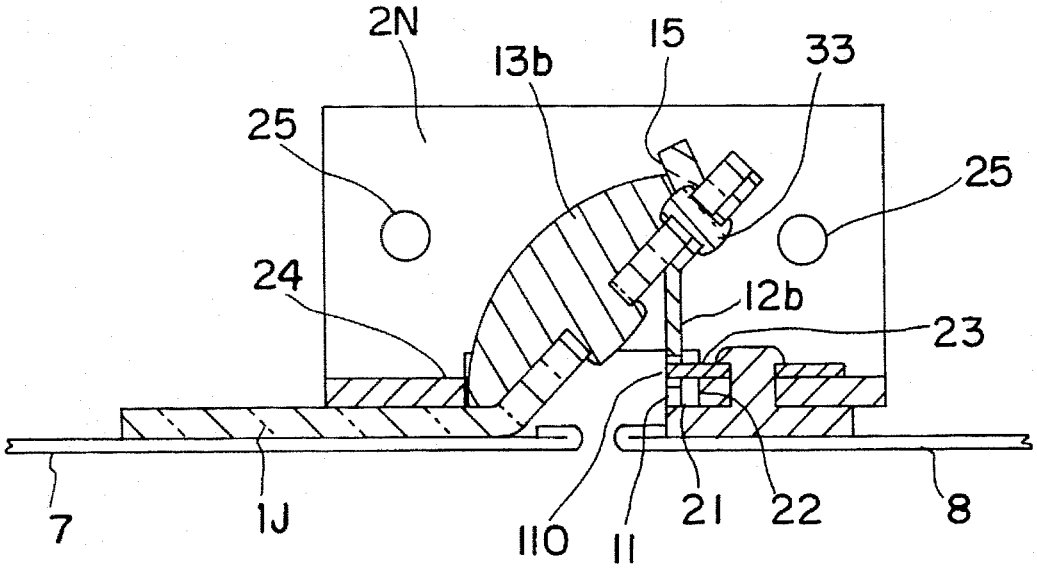
FIG. 22 is a sectional view showing another example of the fifth embodiment.
Figure 23:
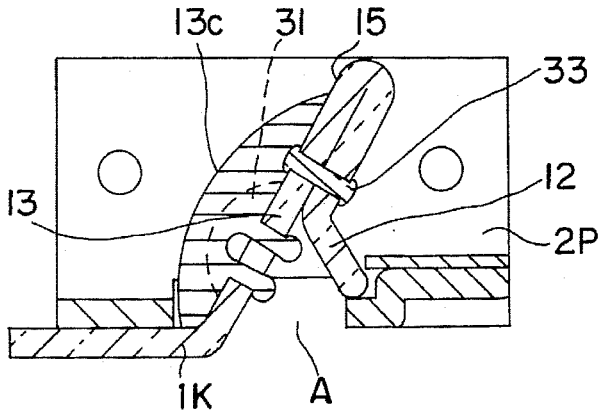
FIG. 23 is a sectional view showing an essential portion of a further other example of the fifth embodiment.
Figure 24:
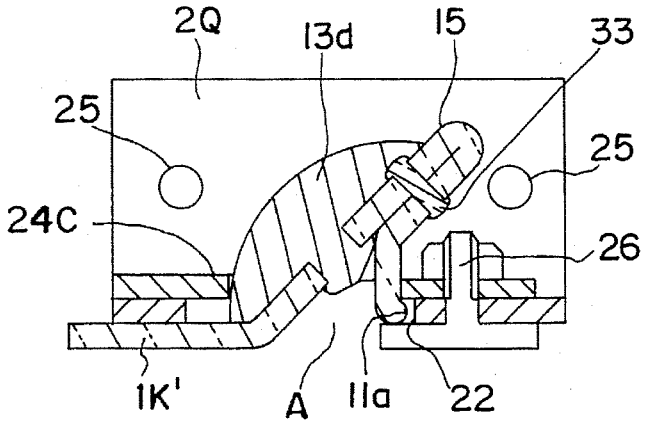
FIG. 24 is a sectional view showing an essential portion of a still other example of the fifth embodiment.
Figure 25:
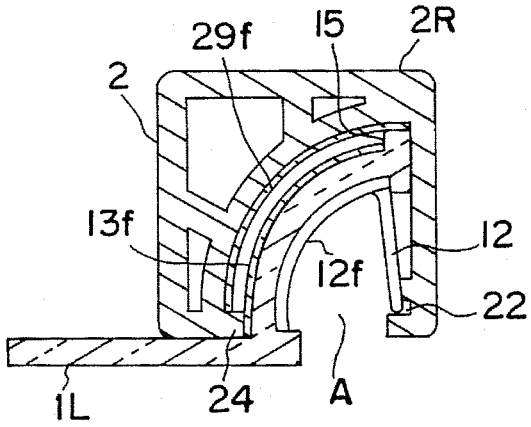
FIG. 25 is a sectional view showing an essential portion of the sixth embodiment.
Figure 26:
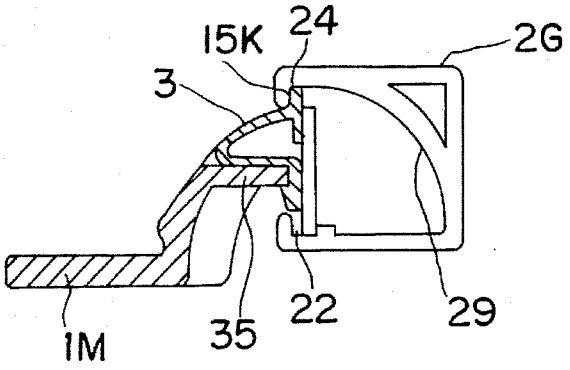
FIG. 26 is a sectional view showing an essential portion of the seventh embodiment.
Figure 27:
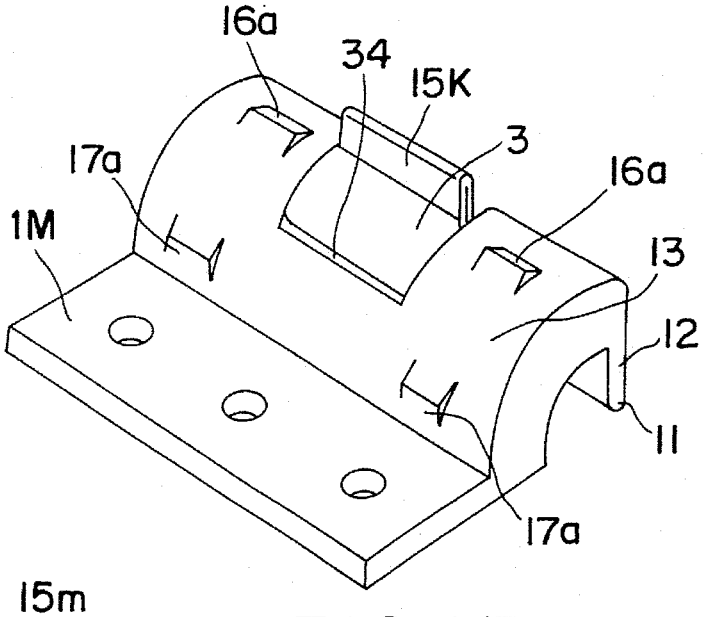
FIG. 27 is a perspective view showing the axial member of the seventh embodiment.
Figure 28:
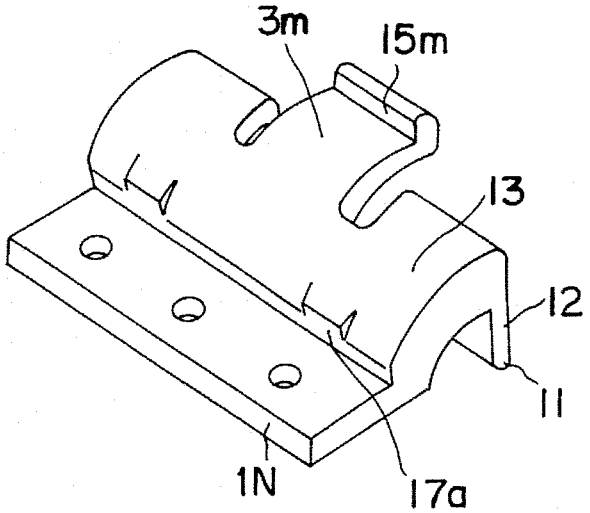
FIG. 28 is a perspective view showing another example of FIG. 27.
Figure 29:
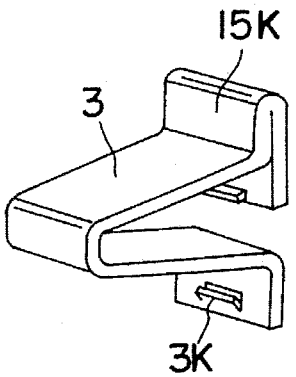
FIG. 29 is a perspective view of the resilient spring of FIG. 26.
Figure 30:
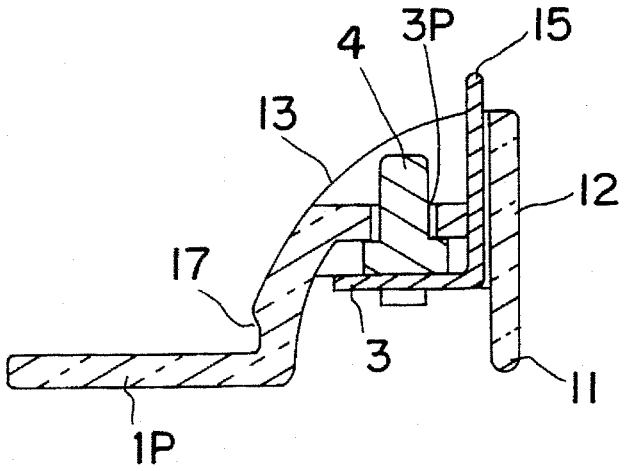
FIGS. 30 and 31 are sectional views showing an essential portion of the eighth embodiment.
Figure 31:
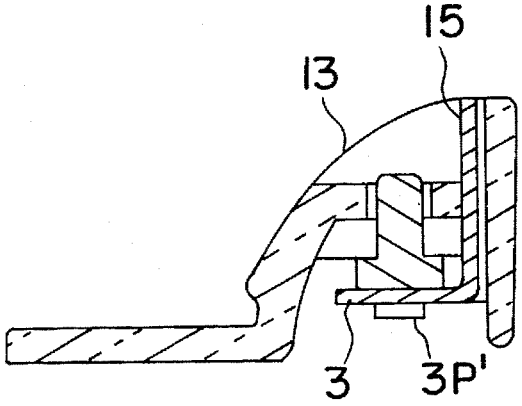
Figure 32:
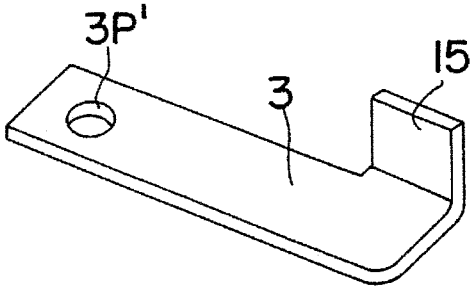
FIG. 32 is a perspective view showing the resilient spring of the eighth embodiment.
Figure 33:
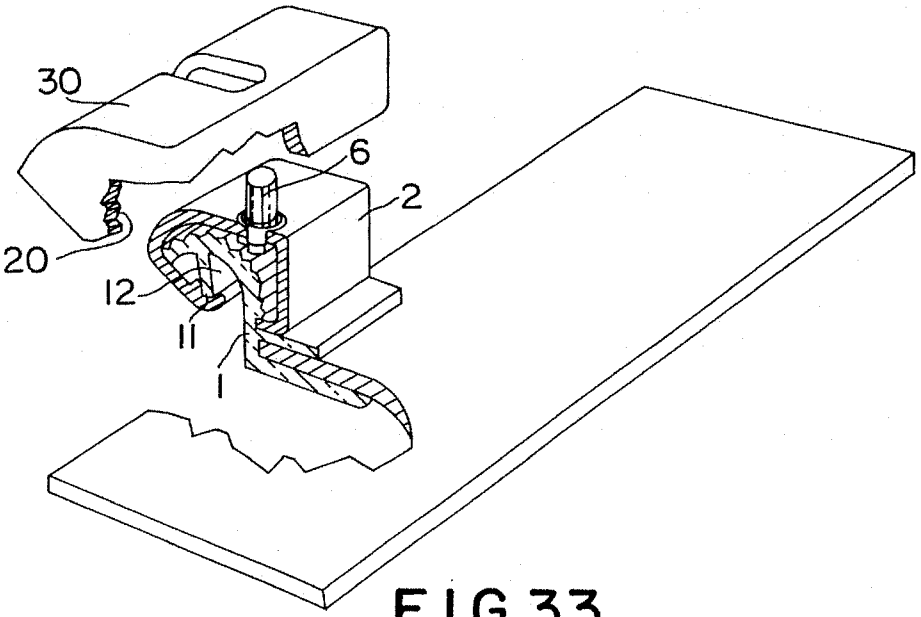
FIG. 33 is a partially cutaway perspective view showing the ninth embodiment.
Figure 34:
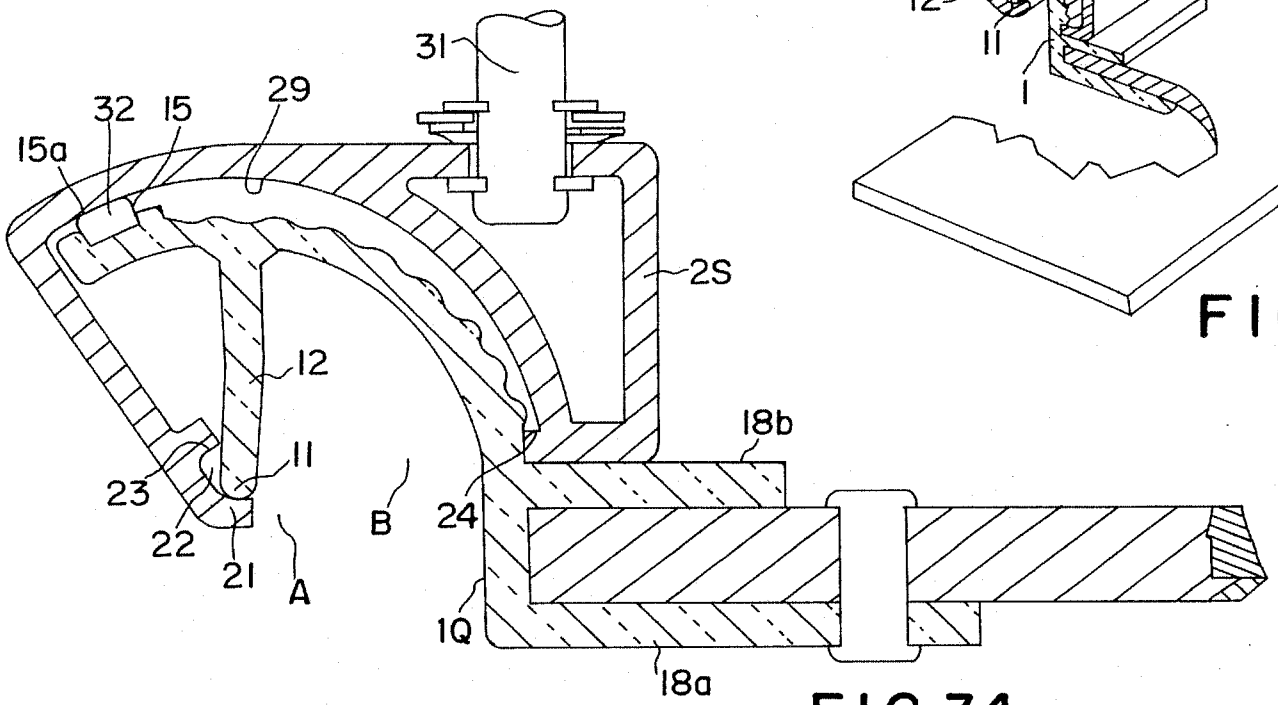
FIG. 34 is a sectional view showing an essential portion of the ninth embodiment.
Figure 35:
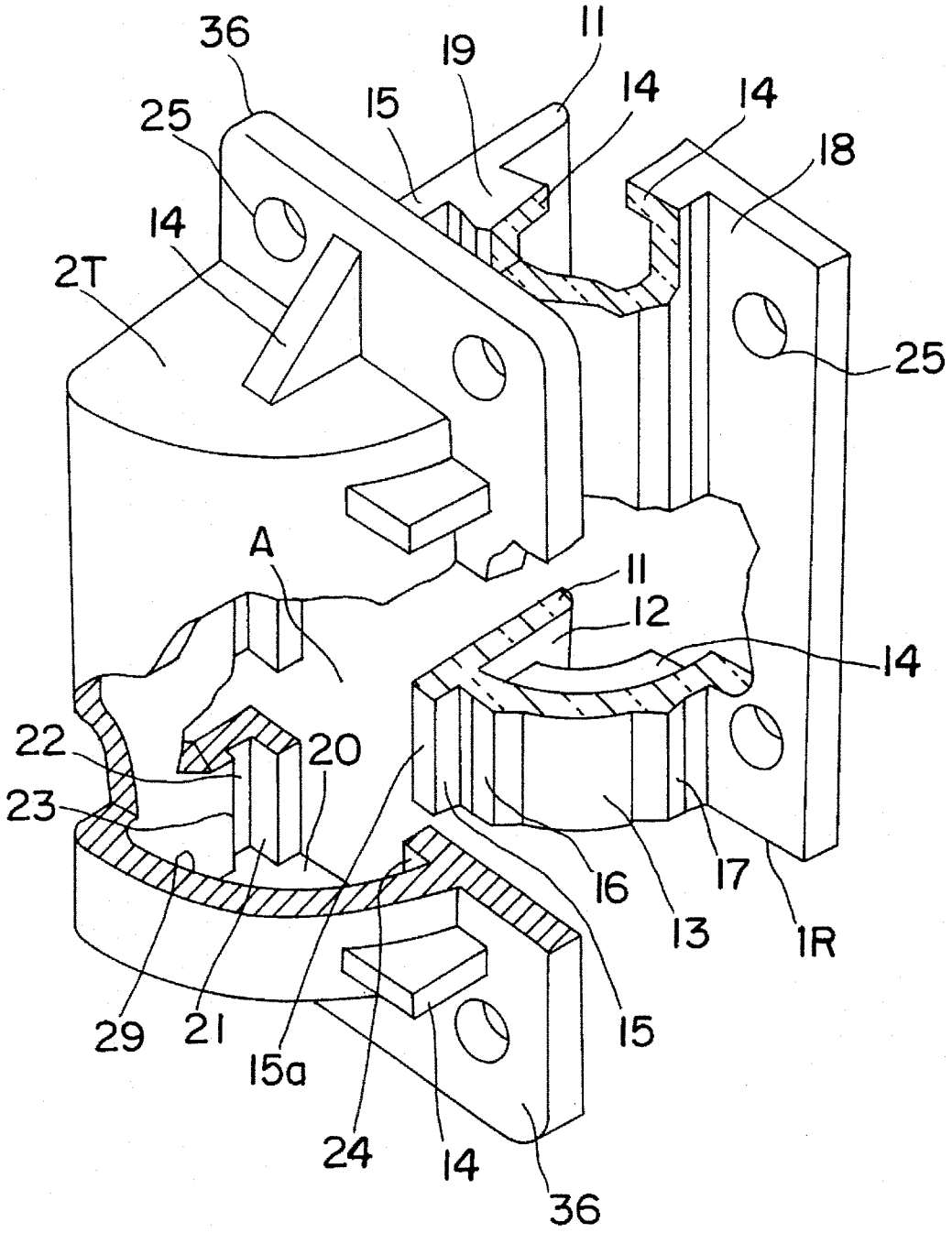
FIG. 35 is a partially cutaway perspective view showing a further other example of the second embodiment.
Figure 36:
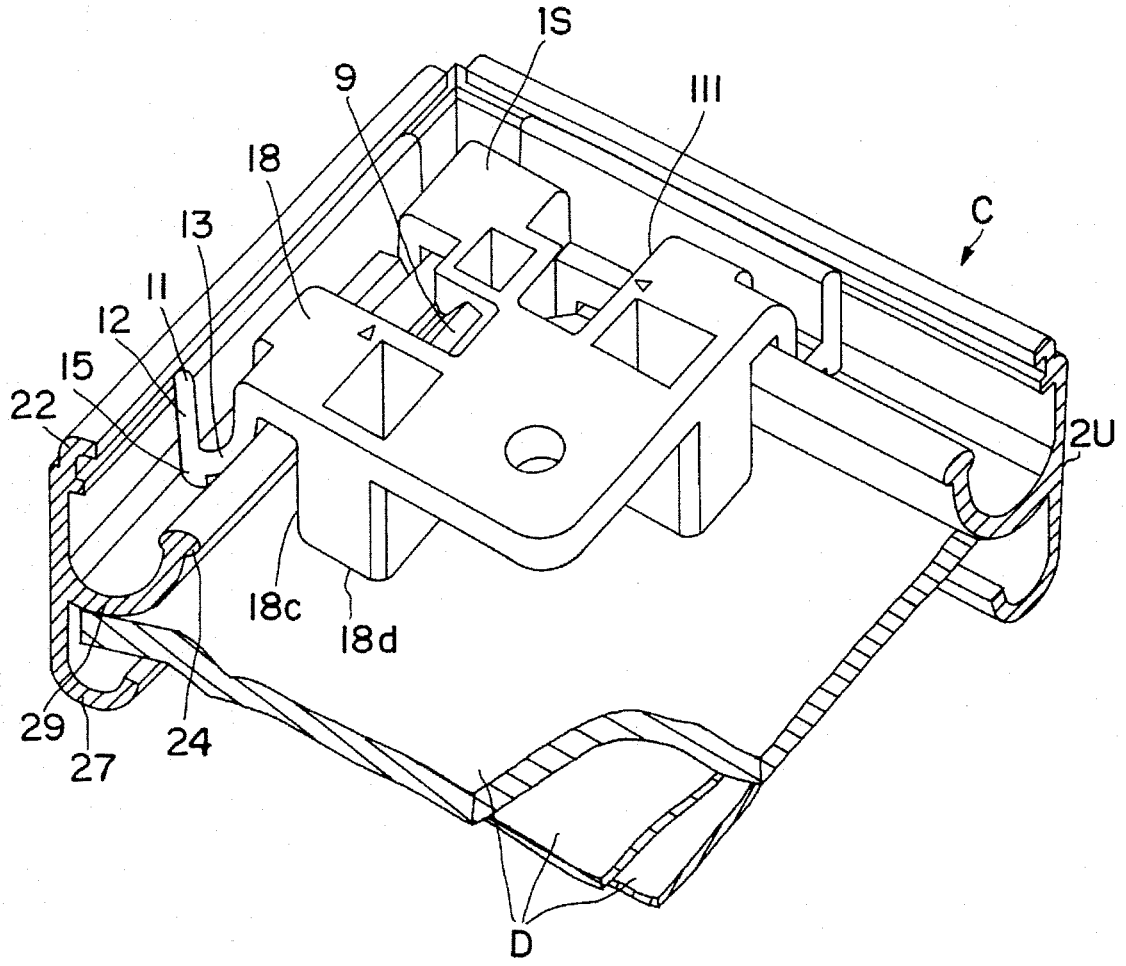
FIG. 36 is a perspective view showing the tenth embodiment.
Figure 37:
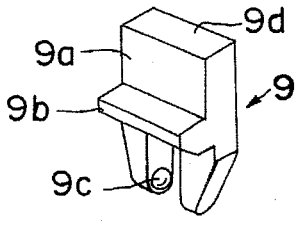
FIG. 37 is a sectional view showing an essential portion of the eleventh embodiment and a perspective view showing a lock member.
Figure 37:
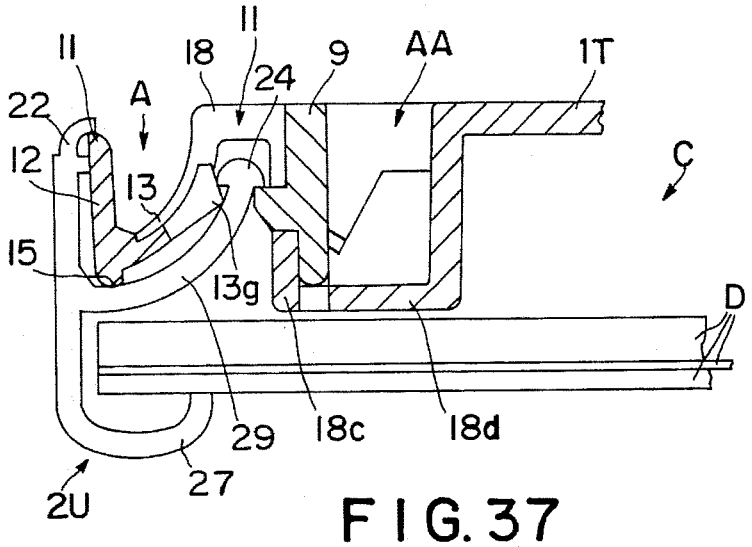
Figure 38:
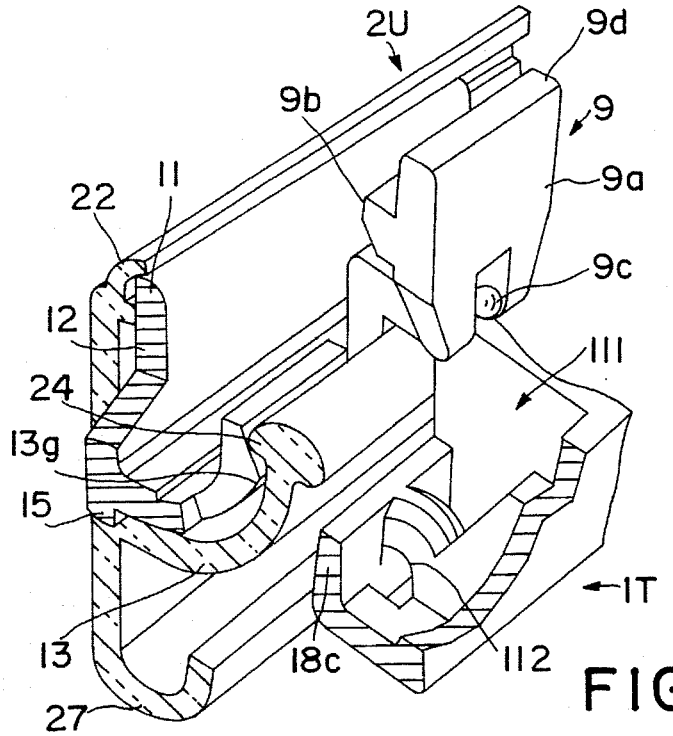
FIG. 38 is a partially cutaway perspective view showing the eleventh embodiment.
Figure 39:
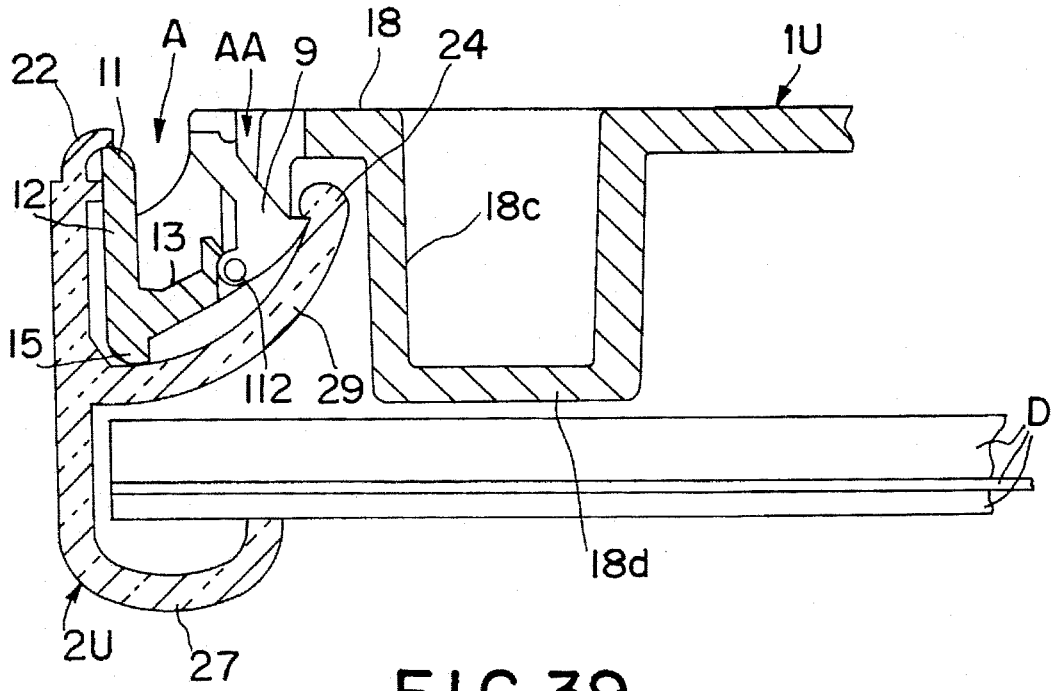
FIG. 39 is a sectional view showing an essential portion of the twelfth embodiment.
Figure 40:
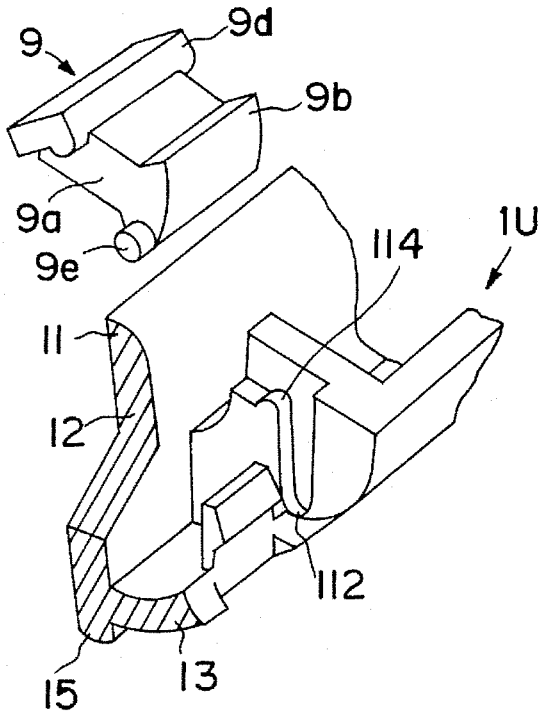
FIG. 40 is a partially cutaway perspective of the twelfth embodiment.
Figure 41:
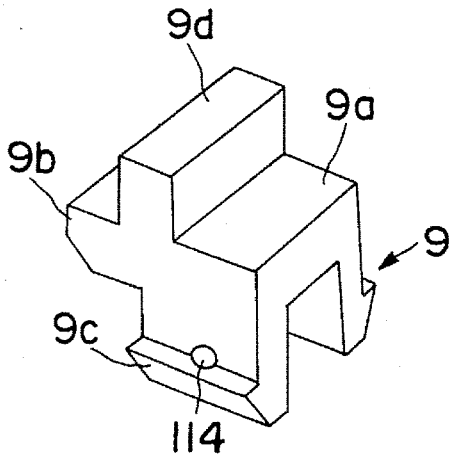
FIG. 41 is a sectional view showing an essential portion of the thirteenth embodiment and a perspective view showing a lock member.
Figure 41:
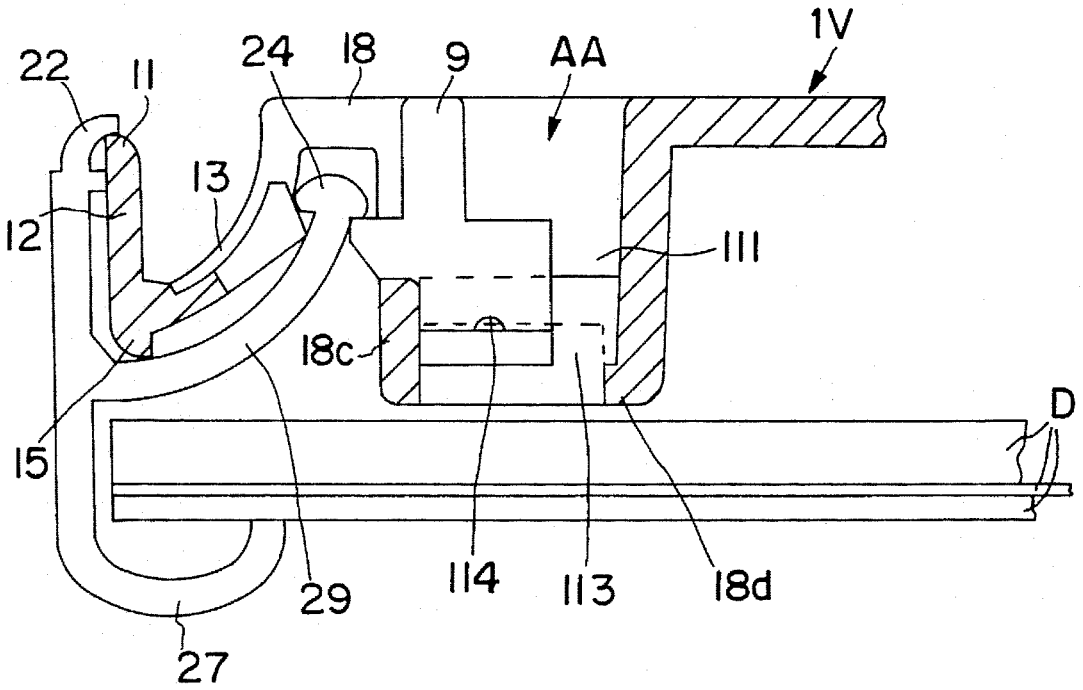
Figure 42:
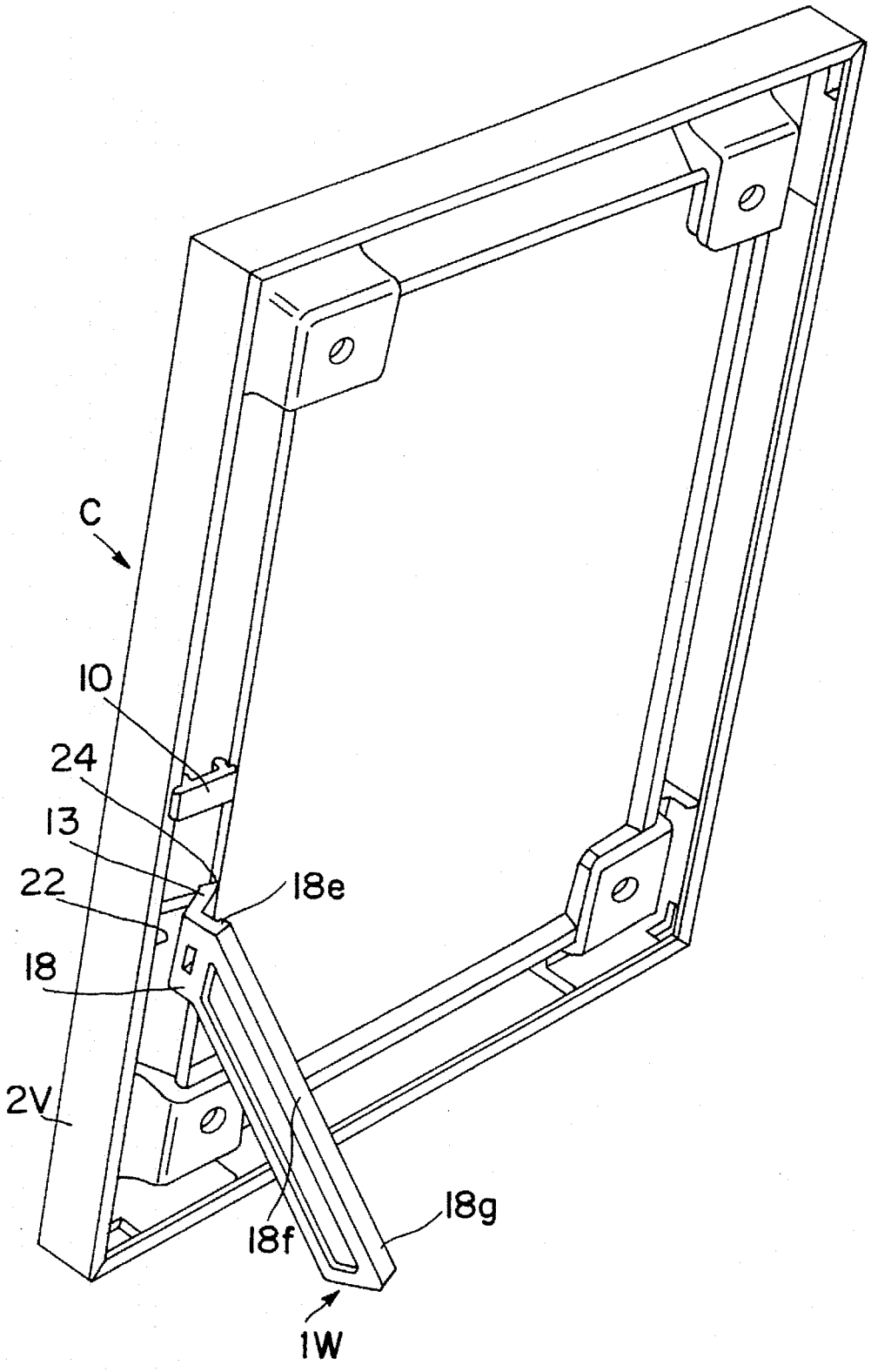
FIG. 42 is a perspective view showing a picture frame mounted with the auxiliary device of the fourteenth embodiment.
Figure 43:
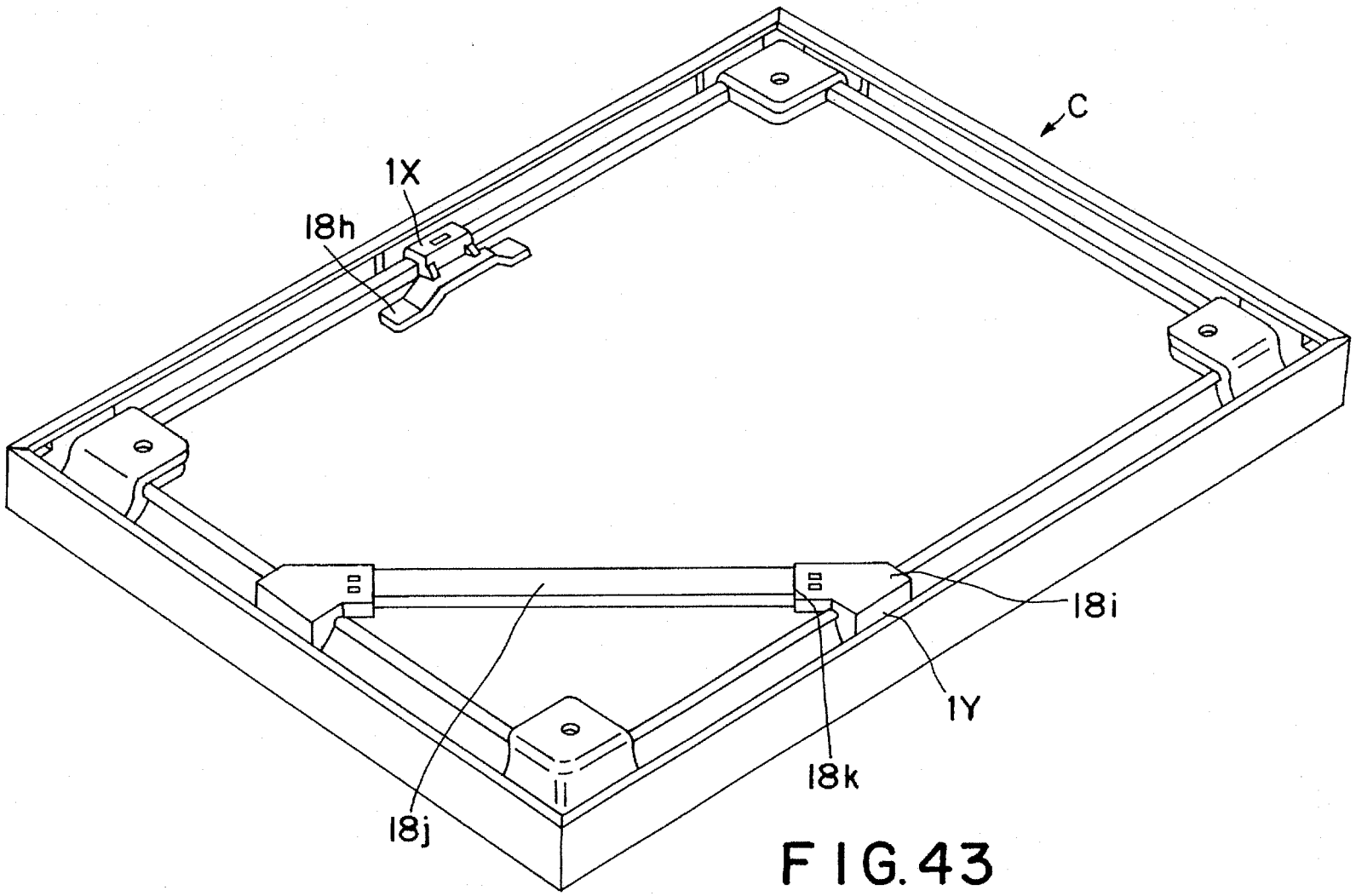
FIG. 43 is a perspective view showing the auxiliary devices of the fifteenth and sixteenth embodiments.
Figure 44:
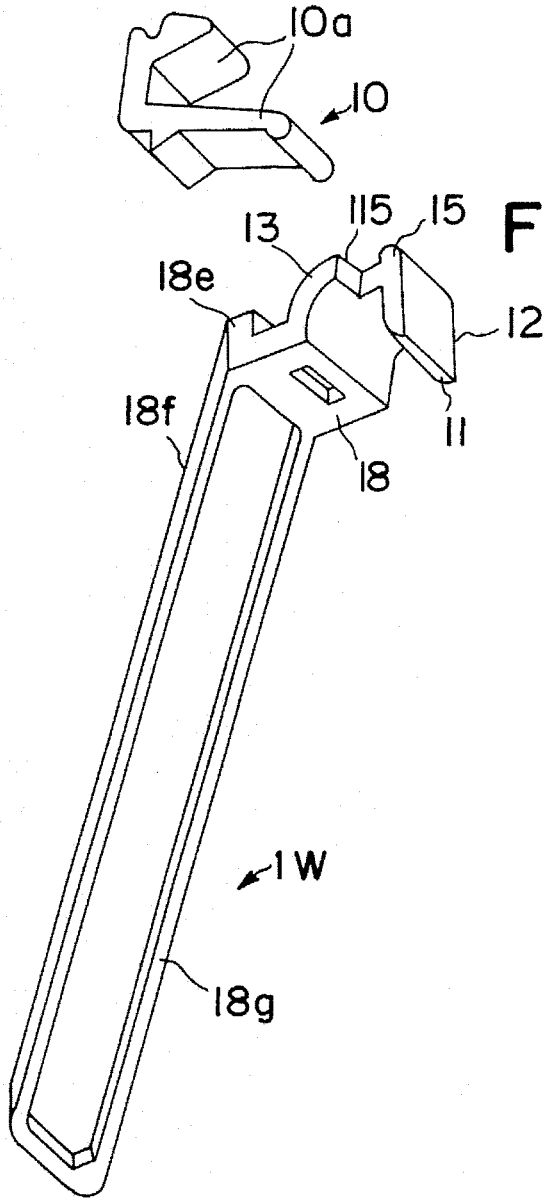
FIG. 44 is a perspective view showing the auxiliary device of the fourteenth embodiment.
Figure 45:
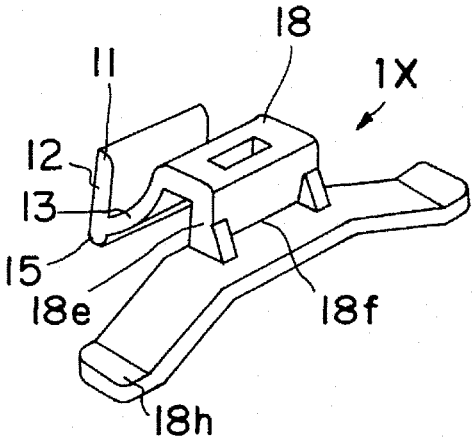
FIG. 45 is a perspective view showing the auxiliary device of the fifteenth embodiment.
Figure 46:
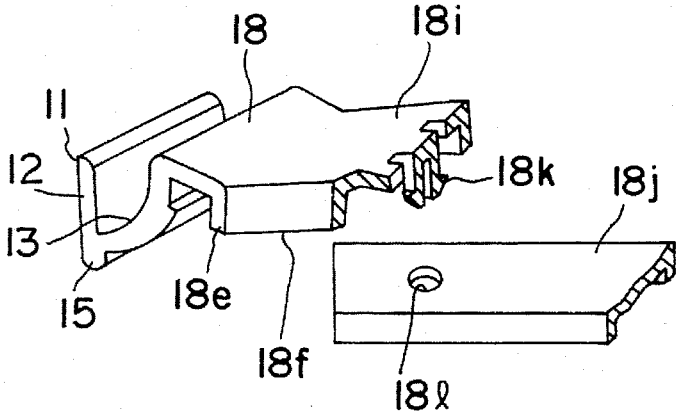
FIG. 46 is a perspective view showing the auxiliary device of the sixteenth embodiment.
Figure 47:
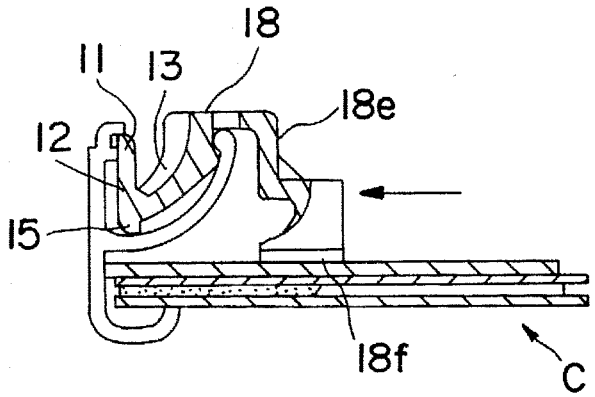
FIG. 47 is sectional views showing how the respective auxiliary devices of the fourteenth to eighteenth embodiments are connected or used with a frame member.
Figure 47:
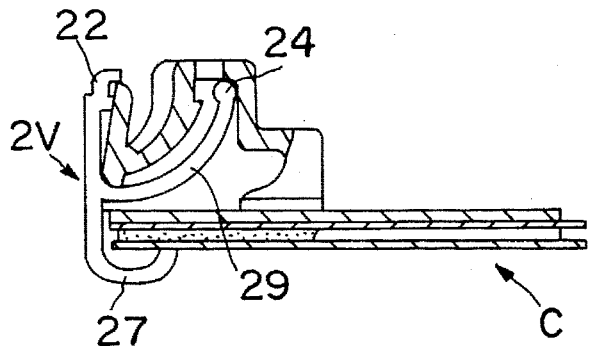
Figure 47:
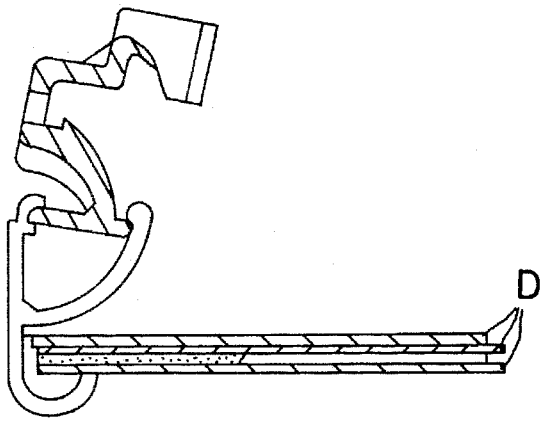
Figure 48:
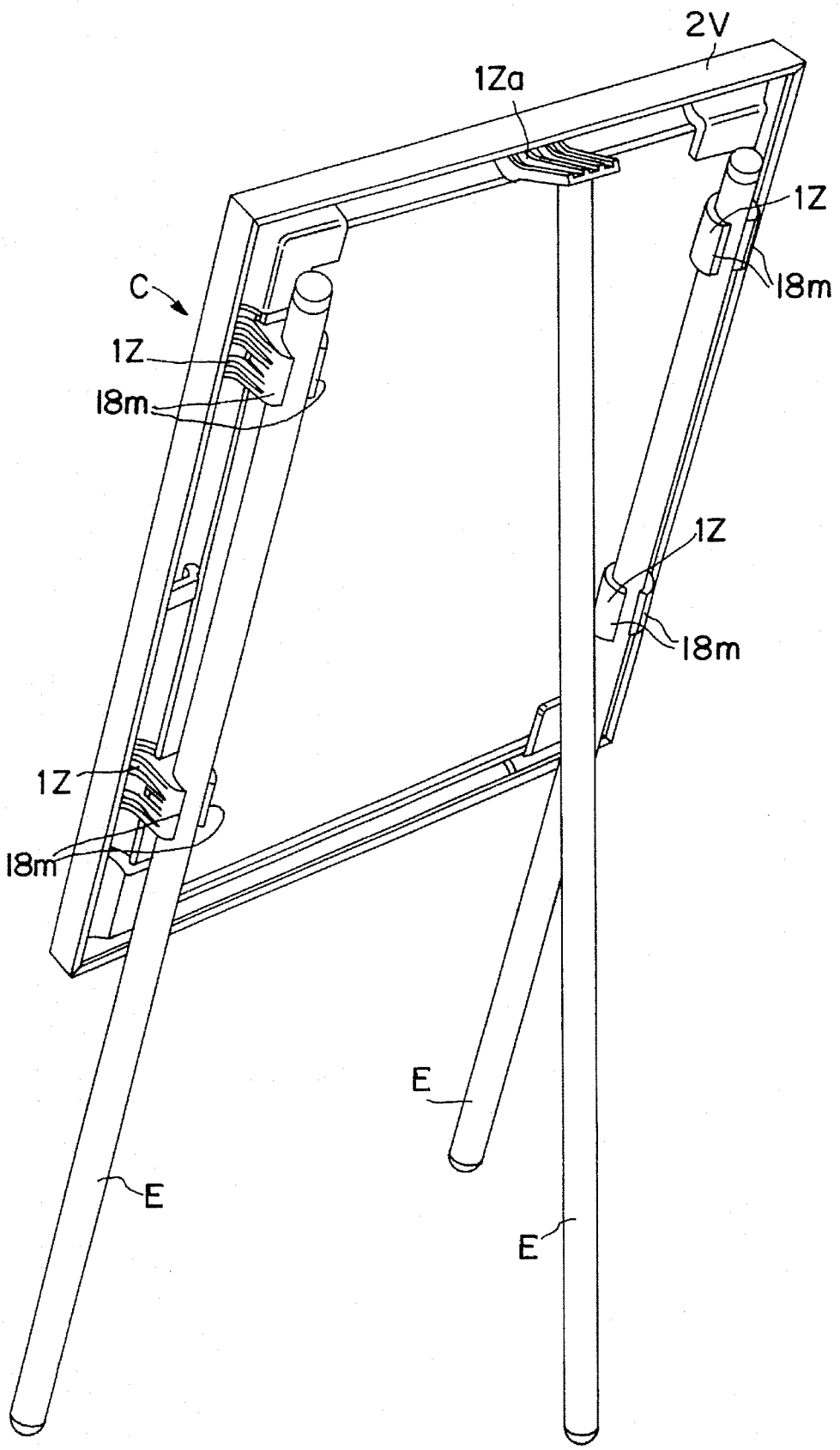
FIG. 48 is a perspective view showing a picture frame mounted with the auxiliary devices of the seventeenth embodiment.
Figure 49:
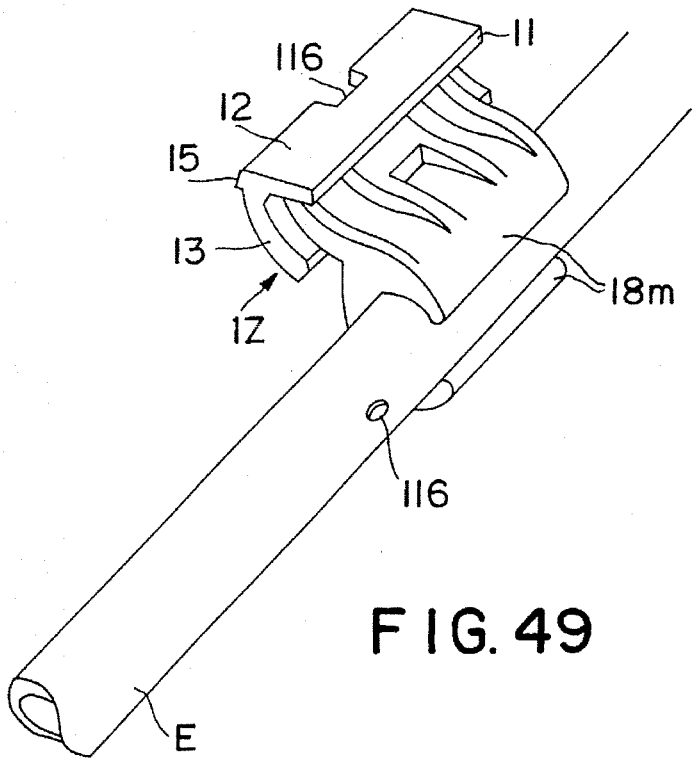
FIG. 49 is a perspective view showing an essential portion of the seventeenth embodiment.
Figure 50:
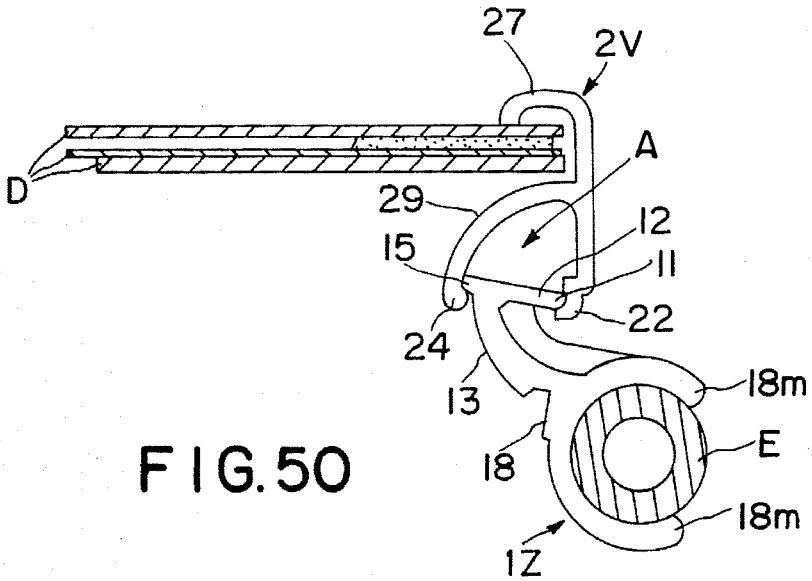
FIG. 50 is a sectional view showing an essential portion of the seventeenth embodiment.
Figure 51:
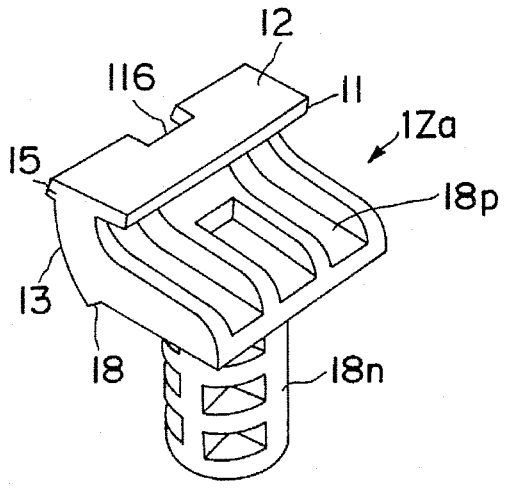
FIG. 51 is a perspective view showing the auxiliary device of the seventeenth embodiment.
Figure 52:
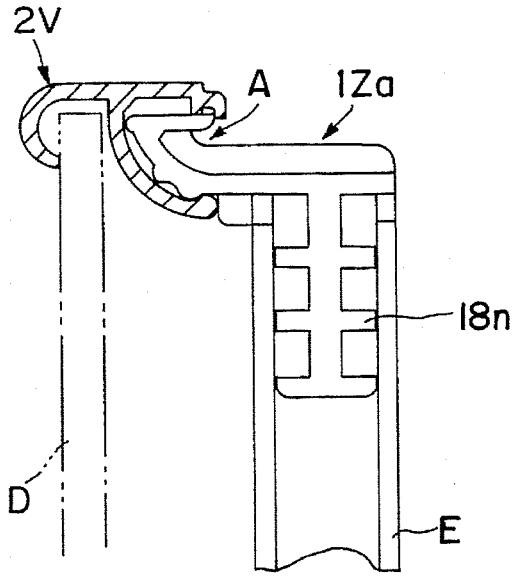
FIG. 52 is a sectional view showing an essential portion of the seventeenth embodiment.
Figure 53:
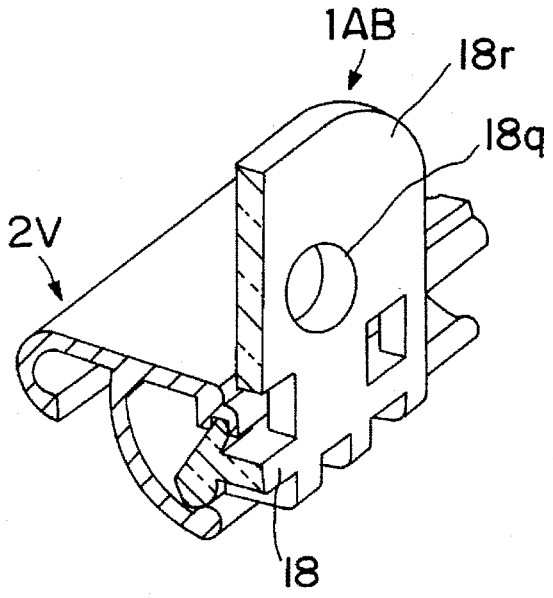
FIG. 53 is a partially cutaway perspective view showing the eighteenth embodiment.
Figure 54:
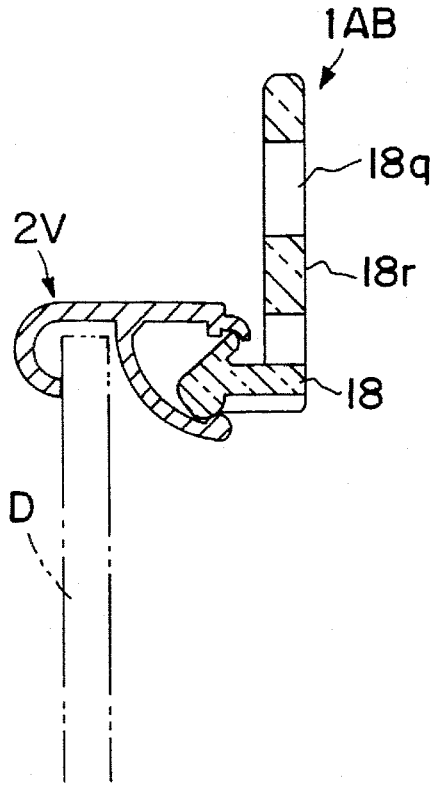
FIG. 54 is a sectional view showing the eighteenth embodiment.
Figure 55:
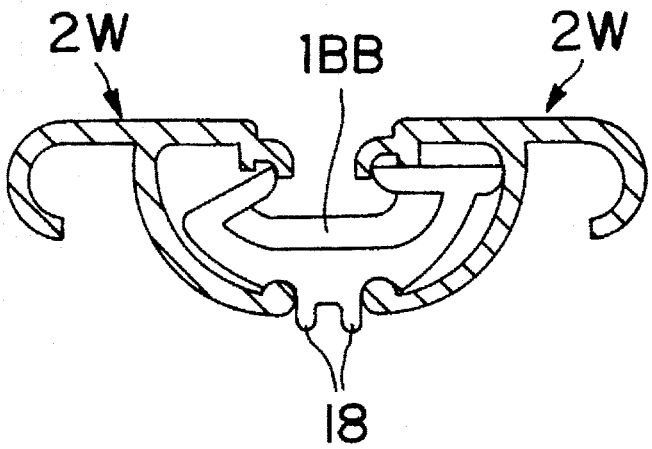
FIG. 55 is a sectional view showing an essential portion of the nineteenth embodiment.
Figure 56:
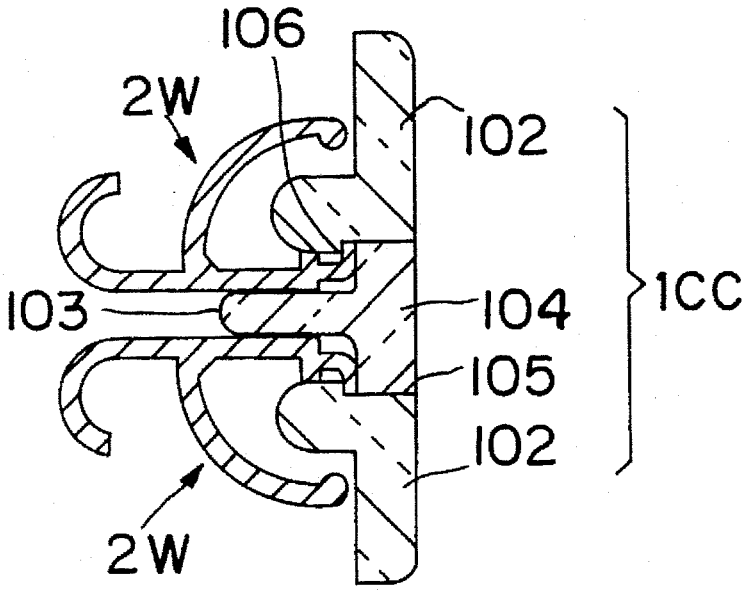
FIG. 56 is a sectional view showing an essential portion of the twentieth embodiment.
Figure 57:
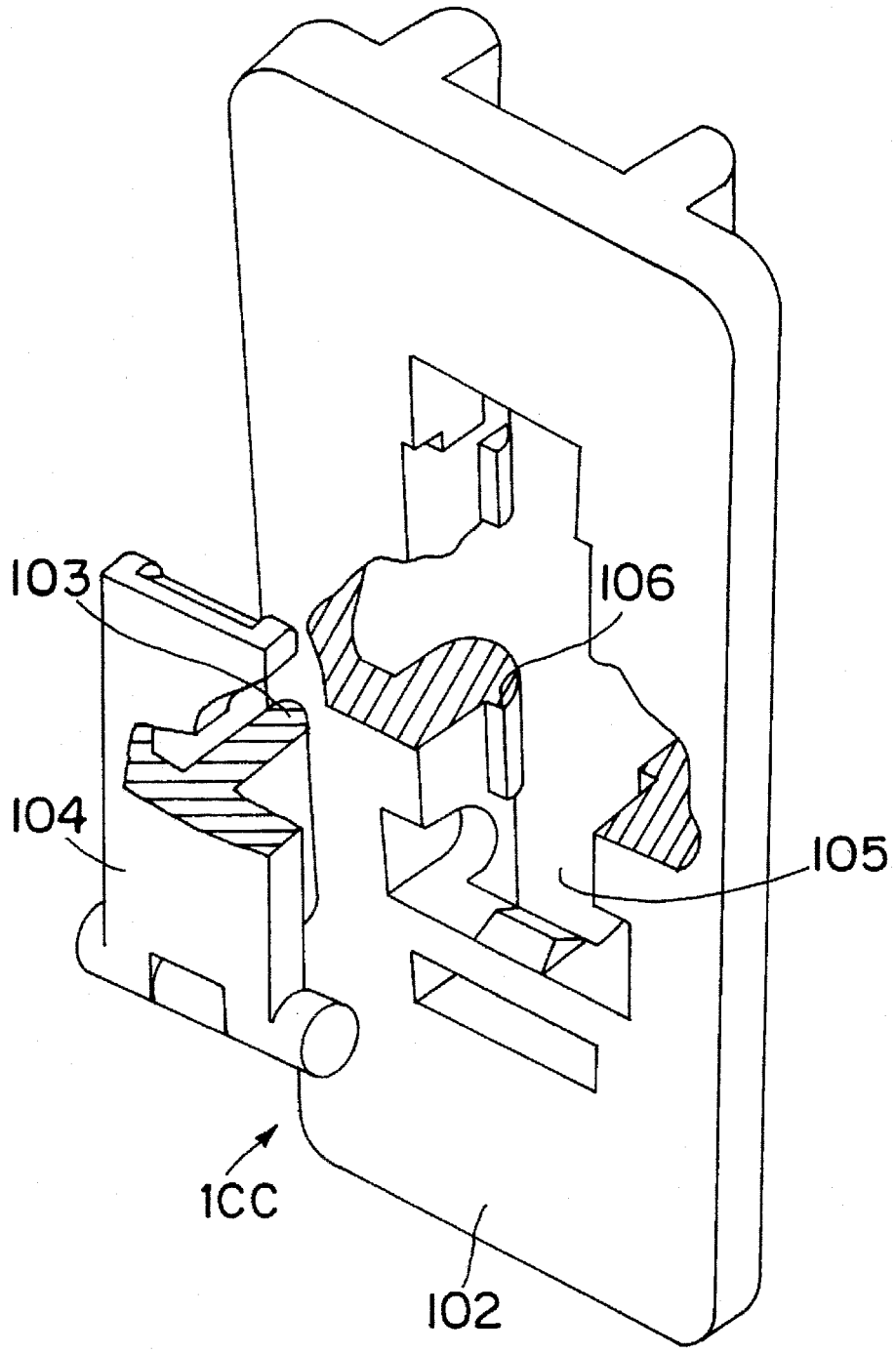
FIG. 57 is a partially cutaway perspective view showing the twentieth embodiment.

I claim:

1. A hinge structure for a pivotable picture frame consisting of an axial member used as a fastener and a pair of axial member supports to use as adjacent frame members, said hinge structure comprising a pivotal portion provided at a base edge of each of a pair of axial blades of the axial member; a disengaging protrusion provided at a tip edge of each of the axial blades; a pivotal rotation guide with the pivotal portion as a center of rotation extending from the axial blades near each of the disengaging protrusions; an engaging extension as a back face of the fastener provided at tip edges of the pivotal rotation guides, said engaging extension including a pair of fastener depth portions extending toward a back face of an exhibited object and a fastener contact face provided in parallel to the engaging extension and in contact with the back face of the exhibited object; an opening formed in each of the axial member supports; a pivotal portion rest to be engaged with a corresponding pivotal portion, said pivotal portion rest formed at one end on one side face of the opening; a curved retainer for keeping the surface of the exhibited object pressed and fixed between said curved retainer and said engaging extension, said curved retainer formed at an other end on said one side face of the opening; a projected engagement rest to be engaged with a corresponding disengaging protrusion or the engaging extension by the pivotal rotation of the axial member, said projected engagement formed on an other side face opposite to said one side face; a curvature formed along a circumference of a corresponding pivotal rotation guide from the engagement rest to said one side face with the pivotal portion rest formed; and a pair of lock members pivotally or slidably provided in the axial member for locking such that a locking claw protruded from the main body of each of the locking members engages with a portion immediately below a corresponding engagement rest.

2. A hinge structure for a pivotable picture frame consisting of an axial member used as a fastener and a pair of axial member supports used as adjacent frame members, said hinge structure comprising a pivotal portion provided at a base edge of each of a pair of axial blades of the axial member; a disengaging protrusion provided at a tip edge of each of the axial blades, a pivotal rotation guide with the pivotal portion as a center of rotation extending from the axial blades near each of the disengaging protrusions; an engaging extension as a back face of the fastener provided at tip edges of the pivotal rotation guides, said engaging extension including a pair of fastener depth portions extending toward a back face of an exhibited object and a fastener contact face provided in parallel to the engaging extension and in contact with the back face of the exhibited object; an opening formed in each of the axial member supports; a pivotal portion rest to be engaged with a corresponding pivotal portion, said pivotal portion rest formed at one end on one side face of the opening; a curved retainer for keeping the surface of the exhibited object pressed and fixed between said curved retainer and said engaging extension, said curved retainer formed at an other end on said one side face of the opening; a projected engagement rest to be engaged with a corresponding disengaging protrusion or the engaging extension by the pivotal rotation of the axial member, said projected engagement rest formed on an other side face opposite to said one side face; a curvature formed along a circumference of a corresponding pivotal rotation guide from the engagement rest to said one side face with the pivotal portion rest formed; a pair of cut out spaces with an opening respectively formed by cutting out the engaging extension and fastener depth portions; a pair of mutually facing pivotal portions of the fastener formed in parallel to the fastener depth portion below each of the cut out spaces; each of a pair of lock members provided with a locking claw protruding horizontally from its main body pivotally provided in each of the cut out spaces; a pair of pivotal portions of each of the lock members to be pivotally engaged with the pivotal portions of the fastener, said pair of pivotal portions being formed at a base edge of the main body of the lock member; and each of a pair of finger action parts accessible from the opening of the disengaging extension in each of the cut out spaces formed a top of the main body of the lock member.

3. A hinge structure for a pivotable picture frame consisting of an axial member used as a fastener and a pair of axial member supports to use as adjacent frame members, said hinge structure comprising a pivotal portion provided at a base edge of each of a pair of axial blades of the axial member; a disengaging protrusion provided at a tip edge of each of the axial blades; a pivotal rotation guide with the pivotal portion as a center of rotation extending from the axial blades near each of the disengaging protrusions; an engaging extension as a back face of the fastener provided at tip edges of the pivotal rotation guides, said engaging extension including a pair of fastener depth portions extending toward a back face of an exhibited object and a fastener contact face provided in parallel to the engaging extension and in contact with the back face of the exhibited object; an opening formed in each of the axial member supports; a pivotal portion rest for engaging with a corresponding pivotal portion, said pivotal rotation rest formed at one end on one side face of the opening; a curved retainer for keeping a surface of the exhibited object pressed and fixed between said curved retainer and said engaging extension, said curved retainer being formed at an other end on said one side face of the opening; a projected engagement rest for engaging with a corresponding disengaging protrusion or the engaging extension by the pivotal rotation of the axial member, said protected engagement rest being formed on an other side face opposite to said one side face; a curvature formed along a circumference of a corresponding pivotal rotation guide from the engagement rest to said one side face with the pivotal portion rest formed thereon; a pair of cut out spaces respectively with an opening, said pair of cut out spaces being formed by cutting out the pivotal rotation guides of the axial member and the engaging extension; a pair of mutually facing pivotal portions of the fastener formed in parallel to the pivotal rotation guide below each of the cut out spaces; each of the pair of lock members is provided with a locking claw protruding horizontally from its main body pivotally provided in each of the cut out spaces; a pair of pivotal portions at each of the lock members for pivotally engaging with the pivotal portions of the fastener, said pair of pivotal portions being formed at a base edge of the main body of the lock member; and each of a pair of finger action parts accessible from the opening of the disengaging extension at each of the cut out spaces is formed as a top of the main body of the lock member.

4. A hinge structure for a pivotable picture frame consisting of an axial member used as a fastener and a pair of axial member supports to use as adjacent frame members, said hinge structure comprising a pivotal portion provided at a base edge of each of a pair of axial blades of the axial member; a disengaging protrusion provided at a tip edge of each of the axial blades; a pivotal rotation guide with the pivotal portion as it center of rotation extending from the axial blades near each of the disengaging protrusions; an engaging extension as a back face of the fastener provided at tip edges of the pivotal rotation guides, said engaging extensions being further provided with a pair of fastener depth portions extending toward a back face of an exhibited object and with a fastener contact face provided in parallel to the engaging extension and in contact with the back face of the exhibited object; an opening formed in each of the axial member supports; a pivotal portion rest to be engaged with a corresponding pivotal portion, formed at one end on one side face of the opening; a curved retainer for keeping a surface of the exhibited object pressed and fixed between the curved retainer and the engaging extension, said curved retainer being formed at an other end on said one side face of the opening; a projected engagement rest to be engaged with a corresponding disengaging protrusion or the engaging extension by the pivotal rotation of the axial member formed on an other side face opposite to said one side face; a curvature formed along a circumference of a corresponding pivotal rotation guide from the engagement rest to said one side face with the pivotal portion rest formed; a pair of cut out spaces respectively with an opening, said pair of cut out spaces being formed by putting out the engaging extension and the fastener depth portion; a pair of mutually facing sliding portions of the fastener formed at right angles to the fastener depth portion below each of the cut out spaces; each of a pair of lock members being provided with a locking claw producing horizontally from its main body slidably provided in each of the cut out spaces; a pair of sliding portions of each of the lock members to be slidably engaged with the sliding portions of the fastener, said pair of sliding portions being formed at the base edge of the main body of the lock member; and each of a pair of finger action parts accessible from the opening in each of the cut out spaces formed as a top of the main body of the lock member.

5. A hinge structure for a pivotable picture frame consisting of an axial member used as an auxiliary device and an axial member support used as a frame member, said hinge structure comprising a pivotal portion provided at a base edge of an axial blade of the axial member used as an auxiliary device; a disengaging protrusion provided at a tip edge of the axial blades; a pivotal rotation guide with the pivotal portion as a center of rotation extending from the axial blades near each of the disengaging protrusions, an engaging extension as a back face of the auxiliary device provided at a tip edge of the pivotal rotation guide, said engaging extension being provided an auxiliary device depth portions extending toward a back face of an exhibited object and with an auxiliary device contact face provided in parallel to the back face of the auxiliary device and in contact with the back face of the exhibited object; an opening formed in the axial member support; a pivotal portion rest for engaging with the pivotal portion formed at one end on one side face of the opening; a curved retainer for keeping a surface of the exhibited object pressed and fixed between the curved retainer and the engaging extension, said curved retainer being formed at an other end on said one side face of the opening; a projected engagement rest for engaging with the disengaging protrusion or the engaging extension by the pivotal rotation of the axial member, said projected engagement rest being formed on an other side face opposite to said one side face; a curvature formed along a circumference of the pivotal rotation guide from the engagement rest to said one side face with the pivotal portion rest formed; and a support rod for supporting the picture frame in an inclined position said support rod being extended from the auxiliary device contact face of the axial member in a different direction.

6. A hinge structure for a pivotable picture frame consisting of an axial member used as an auxiliary device and an axial member support used as a frame member, said hinge structure comprising a pivotal portion provided at the base edge of an axial blade of the axial member; a disengaging protrusion provided at a tip edge of the axial blade; a pivotal rotation guide with the pivotal portion as a center of rotation extending from the axial blade near the disengaging protrusion; an engaging extension as the back face of the auxiliary device provided at a tip edge of the pivotal rotation guide, said engaging extension being provided an auxiliary device depth portion extending toward a back face of the exhibited object and with an auxiliary device contact face provided in parallel to the back face of the auxiliary, device and in contact with the back face of the exhibited object; an opening formed in the axial member support; a pivotal portion rest for engaging with the pivotal portion formed at one end on one side face of the opening; a curved retainer for keeping the surface of the exhibited object pressed and fixed between the curved retainer and the engaging extension, said curved retainer being formed at an other end on said one side face of the opening; a projected engagement rest for engaging with the disengaging protrusion or the engaging extension by the pivotal rotation of the axial member formed on an other side face opposite to said one side face; a curvature formed along a circumference of the pivotal rotation guide from the engagement rest to said one side face with the pivotal portion rest formed; and a retaining rod with a certain length for pressing the exhibited object from its back said retaining rod extending from the auxiliary device contact face of the axial member.

7. A hinge structure for a pivotable picture frame consisting of two axial members used as an auxiliary device and two axial member supports used as two adjacent frame members, said hinge structure comprising a pivotal portion provided at a base edge of an axial blade of each of the axial members; a disengaging protrusion provided at a tip edge of the axial blade; a pivotal rotation guide with the pivotal portion as a center of rotation extending from the axial blades near each of the disengaging protrusions; an engaging extension as the back face of the auxiliary device provided at a tip edge of the pivotal rotation guide, said engaging extension being provided with an auxiliary device depth portion extending toward the back face of an exhibited object and with an auxiliary device contact face provided in parallel to the back rice of the auxiliary device and in contact with the back face of the exhibited object; an opening formed in each of the axial member supports; a pivotal portion rest for engaging with the pivotal portion, said pivotal portion rest being formed at one end on one side face of the opening; a curved retainer for keeping the surface of the exhibited object pressed and fixed between the curved retainer and the engaging extension, said curved retainer being formed at an other end on said one side face of the opening; a projected engagement rest for engagement with the disengaging protrusions or the engaging extension by the pivotal rotation of the axial member formed on an other side face opposite to said one side face; a curvature formed along a circumference of the pivotal rotation guide from the engagement rest to said one side face with the pivotal portion rest formed; a solid rod extending from the auxiliary device contact face of one of the axial members toward an other frame member; and an auxiliary device joint for connecting with an other solid rod or with an extension rod connected with the other solid rod, said auxiliary device joint being formed on said solid rod.

8. A hinge structure for a pivotable picture frame consisting of an axial member used as an auxiliary device and an axial member support used as a frame member, said hinge structure comprising a pivotal portion provided at a base edge of an axial blade of the axial member; a disengaging protrusion provided at a tip edge of the axial blade; a pivotal rotation guide with the pivotal portion as a center of rotation provided on the axial blade, said pivotal rotation guide extending from near the disengaging protrusion; an opening formed in the axial member support; a pivotal portion rest for engagement with the pivotal portion formed at one end on one side face of the opening; a curved retainer for keeping a surface of the exhibited object pressed and fixed between the curved retainer and an engaging extension, said curved retainer being formed at an other end on said one side face of the opening; a projected engagement rest for engagement with the disengaging protrusion or an engaging extension by the pivotal rotation of the axial member, said projected engagement rest being formed on an other side face opposite to said one side face; a curvature formed along a circumference of the pivotal rotation guide from the engagement rest to said one side face with the pivotal portion rest formed; and said engaging extension is formed at a tip edge of the pivotal rotation guide of the axial member, and said engaging extension being provided with an arrestor to be engaged with a rod.

9. A hinge structure for a pivotable picture frame consisting of an axial member used as an auxiliary device and an axial member support used as a frame member, said hinge structure comprising a pivotal portion provided at a base edge of an axial blade of the axial member; a disengaging protrusion provided at a tip edge of the axial blade; an opening formed in the axial member support; a pivotal portion rest for engagement with the pivotal portion formed at one end on one side face of the opening; a curved retainer for keeping the surface of the exhibited object pressed and fixed between said curved retainer and an engaging extension, said curved retainer being formed at an other end on said one side face of the opening; a projected engagement rest for engagement with the disengaging protrusion or said engaging extension by the pivotal rotation of the axial member, said projected engagement rest being formed on an other side face opposite to said one side face; a curvature with the pivotal portion test as the center of rotation formed from the engagement rest to said one side with the pivotal portion rest formed; and said engaging extension is formed at a tip edge of a pivotal rotation guide of the axial member, and said engaging extension being provided with a hanging piece and a hanging portion formed therein.

10. A hinge structure for allowing pivotable picture frames to be presented for exhibition as a pair, consisting of an axial member used as an auxiliary device and two axial member supports used as a frame members, said hinge structure comprising an opening formed in each of the axial member supports; a pivotal portion rest for engagement with a corresponding one of a pair of pivotal portions of the axial member, said pivotal portion rest being formed at one end on one side of the opening; a curved retainer for keeping a surface of the exhibited object pressed and fixed between said curved retainer and a pair of engaging extensions, said curved retainer being formed at an other end on said one side face of the opening; a projected engagement rest to be engaged with the disengaging protrusion or a corresponding one of a pair of disengaging protrusions or a corresponding one of said pair of engaging extensions by the pivotal rotation of the axial member, said projected engagement rest being formed on an other side face opposite to said one side face; a curvature with the pivotal portion rest as the center of rotation formed from the engagement rest to said one side with the pivotal portion rest formed; a pivotal rotation guide for connecting the two axial member supports to have two picture frames kept close to each other back to back or at right angles, said pivotal rotation guide being formed in the axial member and having axial blades extending from both sides; two pivotal portions for engagement with the pivotal portion rest formed at base edges of respective axial blades; said disengaging protrusions formed at a tip of at least one of the axial blades; and said pair engaging extensions to be engaged with the engagement rests of two respective axial member supports kept closely to each other, said pair of engaging extensions being formed at a center of the pivotal rotation guide.

11. A hinge structure for allowing pivotable picture frames to be presented for exhibition as a pair, consisting of an axial member used as an auxiliary device and two axial member supports used as a frame members, said hinge structure comprising an opening formed in each of the axial member supports; a pivotal portion rest for engagement with a corresponding one of a pair of pivotal portions of the axial member, said pivotal portion rest being formed at one end on one side of the opening; a curved retainer to keep the surface of the exhibited object pressed and fixed between the curved retainer and an engaging extension of said auxiliary device, said curved retainer being formed at an other end on said one side face of the opening; a connection board for connecting mutually closely located member frames to keep the two picture frame side by side, said connection board being formed in the axial member; an insertion hole to be filled with an insert with a wedge portion formed in the connection board; a pair of engagement claws to be engaged with the pivotal portion rest of the axial member supports, said pair of engaging claws being provided on both sides of the insertion hole to face each other; wherein said pair of engagement claws are engaged with a pivotal portion rest of the axial member supports, and the wedge potion of the insert is inserted into the insertion hole for holding the two frame members by the wedge portion of the insert and the engagement claws of the connection board.

* * * * *